US008342519B2

(12) United States Patent
Watanabe et al.

(10) Patent No.: US 8,342,519 B2
(45) Date of Patent: Jan. 1, 2013

(54) SHEET CONVEYING DEVICE AND IMAGE FORMING APPARATUS

(75) Inventors: Kenji Watanabe, Suntou-gun (JP); Minoru Kawanishi, Yokohama (JP); Motohiro Furusawa, Suntou-gun (JP); Hiroki Yamaguchi, Mishima (JP); Shigeo Murayama, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 12/904,021

(22) Filed: Oct. 13, 2010

(65) Prior Publication Data

US 2011/0089628 A1 Apr. 21, 2011

(30) Foreign Application Priority Data

Oct. 20, 2009 (WO) ..... PCT/JP2009/068078

(51) Int. Cl.
*B65H 9/04* (2006.01)

(52) U.S. Cl. ..... 271/243; 271/245; 271/246

(58) Field of Classification Search ..... 271/243, 271/245, 246
See application file for complete search history.

(56) References Cited

U.S. PATENT DOCUMENTS 4,132,401 A * 1/1979 Gauronski et al. ..... 271/245
6,011,948 A 1/2000 Amano
6,934,505 B2 * 8/2005 Shin ..... 399/395
2009/0102117 A1 * 4/2009 Yu et al. ..... 271/226

FOREIGN PATENT DOCUMENTS

JP 61027853 A * 2/1986
JP 03259860 A * 11/1991
JP 05338865 A * 12/1993
JP 6-092518 A 4/1994
JP 9-183539 A 7/1997
JP 2001-039583 A 2/2001

* cited by examiner

*Primary Examiner* — David H Bollinger

(74) *Attorney, Agent, or Firm* — Canon USA, Inc., IP Division

(57) ABSTRACT

A sheet conveying device includes a blocking member having a blocking surface with which a leading end of a sheet that is being conveyed comes into contact for obliquity correction. The blocking member is rotated by being pushed by the sheet against an urging force of a positioning unit that positions the blocking member to be in the standby position. The blocking member is rotatable to be in a sheet-passage-allowing orientation in which the sheet is allowed to pass. When a trailing end of the sheet that is being conveyed has passed the blocking member, the blocking member that is in the sheet-passage-allowing orientation rotates in a same direction as a sheet conveyance direction and is positioned to be in a standby position.

10 Claims, 23 Drawing Sheets

SHEET CONVEYING DEVICE AND IMAGE FORMING APPARATUS

TECHNICAL FIELD

The present invention relates to a sheet conveying device and an image forming apparatus including the same.

BACKGROUND ART

Exemplary devices for correcting any obliquity of a sheet that is being conveyed include a device (see PTL 1) that performs correction by using shutters 223 provided adjacent to pairs of rollers 218 and 219, respectively, as shown in a perspective view in FIG. 22. The shutters 223 have contact surfaces 223*a* with which the leading end of the sheet comes into contact, the contact surfaces 223*a* being provided in a direction orthogonal to a sheet conveyance direction.

In the device shown in FIG. 22, when the leading end of a sheet that is conveyed from the upstream side comes into contact with the contact surfaces 223*a* of the shutters 223 that are in a standby position, the leading end of the sheet is blocked with the spring forces of springs provided on the shutters 223, and the sheet bends. When a bend is formed in the sheet, the leading end of the sheet is aligned with the contact surfaces 223*a*. The shutters 223 are pushed to swing by the sheet that is being conveyed, and the leading end of the sheet that is aligned by the shutters 223 is taken into the nips between the respective pairs of rollers 218 and 219 that are rotating. Thus, any obliquity of the sheet is corrected, and the sheet is conveyed toward the downstream side in the conveyance direction. When the trailing end of the sheet that is being conveyed by the pairs of rollers 218 and 219 has passed the contact surfaces 223*a* of the shutters 223, the shutters 223 return to the initial standby position with the urging forces of the springs.

CITATION LIST

Patent Literature

PTL 1 Japanese Patent Laid-Open No. 9-183539

In recent years, with demands for more improved throughput (the number of sheets per unit time on which images are formed) of image forming apparatuses from users, there have been demands for higher sheet conveyance speed and shorter interval from the trailing end of the preceding sheet to the leading end of the subsequent sheet (hereinafter referred to as "sheet interval"). In response to such demands, it has been desired that the shutters return to the standby position for aligning the leading end of the subsequent sheet again after the passage of the trailing end of the preceding sheet on the condition of a short sheet interval.

In the configuration employing the conventional shutters, the shutters are swingably provided on a conveying roller shaft and swing back and forth about the conveying roller shaft every time a sheet passes. Therefore, the minimum sheet interval necessary was to be a distance described as follows. The distance by which the contact surfaces 223*a* of the shutters 223 move from the position shown in FIG. 23A taken when the trailing end of the preceding sheet has passed the contact surfaces 223*a*, at which the shutters 223 come into contact with the sheet, so as to return to the standby position shown in FIG. 23B for aligning the leading end of the subsequent sheet is denoted by a distance D1. The distance by which the subsequent sheet is conveyed during the time the contact surfaces 223*a* of the shutters 223 return to the standby position from the position taken when the trailing end of the preceding sheet has passed the contact surfaces 223*a* is denoted by a distance D2. Then, the minimum distance necessary as the sheet interval between the preceding sheet and the subsequent sheet comes to the sum of the distance D1 and the distance D2 and is denoted by a distance D3 (D1+D2=D3). That is, if the sheet interval is shorter than this distance D3, the subsequent sheet reaches the standby position before the contact surfaces 223*a* of the shutters 223 return to the standby position, resulting in failure in obliquity correction.

To increase the throughput of the image forming apparatus, it can be considered to increase the sheet conveyance speed, instead of reducing the sheet interval. An increase in the sheet conveyance speed, however, leads to a problem described below.

The distance D2 by which the subsequent sheet is conveyed during the returning motion of the shutters is a distance ($\Delta T \times V = D2$) calculated as the time $\Delta T$ during which the shutters 223 rotates from the position shown in FIG. 23A to the standby position shown in FIG. 23B in the direction opposite to the sheet conveyance direction multiplied by the sheet conveyance speed V. Therefore, as the sheet conveyance speed becomes higher, the distance D2 needs to be longer. That is, as the sheet conveyance speed is increased, the minimum distance necessary as the sheet interval needs to be set longer, resulting in substantial incapability in increasing the throughput.

Hence, in the sheet conveying device that corrects any obliquity of the sheet by using the shutters, the degree of improvement of throughput in sheet conveyance (the number of sheets conveyable per unit time) is limited because of the restriction regarding the time required for the shutters to return to the standby position.

SUMMARY OF INVENTION

The present invention is to provide a sheet conveying device that realizes a short sheet interval and corrects any obliquity of the sheet, and an image forming apparatus including the same.

The present invention provides a sheet conveying device including a conveying section that conveys a sheet; a blocking member having a blocking surface with which a leading end of the sheet that is being conveyed by the conveying section comes into contact for obliquity correction; and a positioning unit that positions the blocking member to be in a standby position by applying an urging force to the blocking member. The leading end of the sheet that is being conveyed by the conveying section is blocked by coming into contact with the blocking surface of the blocking member in the standby position. The blocking member is rotated by being pushed by the sheet that is being conveyed by the conveying section against the urging force applied by the positioning unit. The blocking member is rotatable to be in a sheet-passage-allowing orientation in which the sheet is allowed to pass, and, after a trailing end of the sheet that is being conveyed has passed the blocking member, the blocking member that is in the sheet-passage-allowing orientation rotates in a same direction as a sheet conveyance direction and is positioned to be in the standby position.

Further features of the present invention will become apparent from the following description of exemplary embodiments with reference to the attached drawings.

BRIEF DESCRIPTION OF DRAWINGS

FIGS. 15A-1, 15A-2, 15B-1, and 15B-2 are other cross-sectional views showing the behavior of the sheet conveying device according to the third embodiment.

DESCRIPTION OF EMBODIMENTS

First Embodiment

Figure 1:
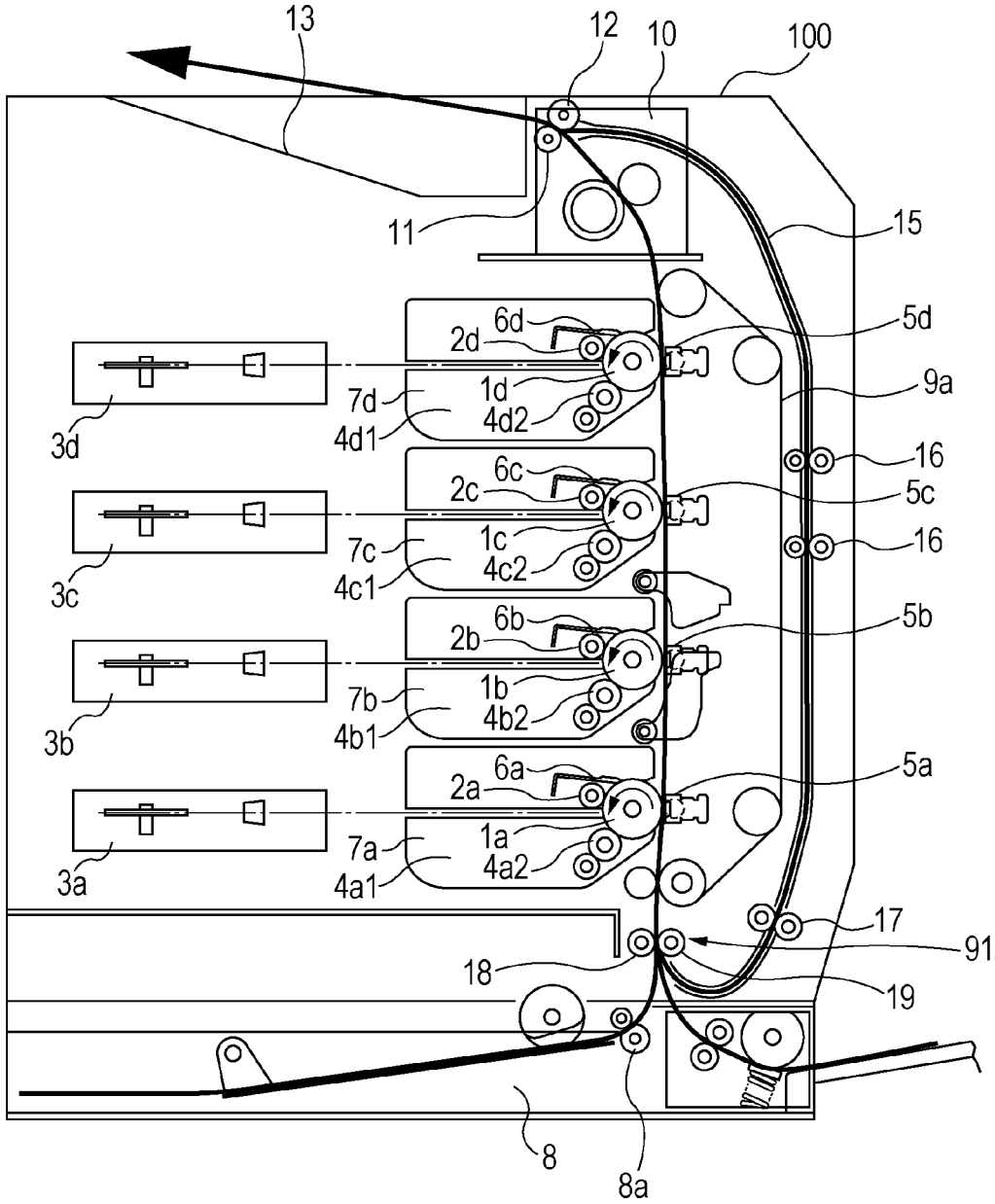
FIG. 1 is an illustrative cross-sectional view that illustrates a first embodiment of the sheet conveying device and the image forming apparatus including the same according to the present invention.

Embodiments of the present invention will now be described with reference to the drawings. Herein, elements common to all the drawings are denoted by common reference numerals. FIG. 1 is a cross-sectional view schematically showing a color printer, which is an exemplary image forming apparatus including a sheet conveying device according to a first embodiment of the present invention. In this embodiment, an electrophotographic, color image forming apparatus that forms a four-color toner image will be described.

Referring to FIG. 1, an image forming apparatus 100 according to the embodiment includes four photoconductor drums 1*a* to 1*d*. Around the photoconductor drums 1, there are provided charging means 2*a* to 2*d* that uniformly charge the surfaces of the photoconductor drums 1, exposing means 3*a* to 3*d* that form electrostatic latent images on the respective photoconductor drums 1 by radiating laser beams in accordance with image information, developing means 4*a* to 4*d* that visualize the respective electrostatic latent images as toner images by making toner adhere to the electrostatic latent images, and transfer members 5*a* to 5*d* that cause the respective toner images on the photoconductor drums 1 to be transferred to a sheet. The photoconductor drums 1*a* to 1*d*, the exposing means 3*a* to 3*d*, the developing means 4*a* to 4*d*, and the transfer members 5*a* to 5*d* form an image forming section that forms an image on a sheet.

Furthermore, cleaning means 6*a* to 6*d* that remove post-transfer toner remaining on the surfaces of the photoconductor drums 1 after the transfer, and so forth are provided. In this embodiment, the photoconductor drums 1, the charging means 2, the developing means 4, and the cleaning means 6 that remove toner integrally form process cartridges 7*a* to 7*d*.

The photoconductor drums 1, functioning as image bearing members, each include an aluminum cylinder whose outer peripheral surface is coated with an organic photoconductive layer (OPC). Each photoconductor drum 1 is rotatably supported by flanges at both ends thereof. A driving force from an unshown drive motor is transmitted to one end of the photoconductor drum 1, whereby the photoconductor drum 1 is driven to rotate counterclockwise in the drawing.

The charging means 2*a* to 2*d* are each a conductive roller having a roller shape. The roller is in contact with the surface of the photoconductor drum 1. Meanwhile, a charging bias voltage is applied to the roller by an unshown power supply. Thus, the surface of the photoconductor drum 1 is uniformly charged. The exposing means 3 each include a polygonal mirror. Image light corresponding to an image signal is applied to the polygonal mirror from an unshown laser diode.

The developing means 4*a* to 4*d* include toner containers 4*a*1, 4*b*1, 4*c*1, and 4*d*1; developing rollers 4*a*2, 4*b*2, 4*c*2, and 4*d*2; and so forth, respectively. The toner containers 4*a*1 to 4*d*1 contain toners of different colors, specifically, black, cyan, magenta, and yellow, respectively. The developing rollers 4*a*2 to 4*d*2 adjoin the surfaces of the respective photoconductor drums 1 and perform development by applying a development bias voltage while being driven to rotate.

A transfer belt 9*a* with which the sheet is conveyed upward is provided in such a manner as to face the four photoconductor drums 1*a* to 1*d*. The transfer members 5*a* to 5*d* are provided on the inside of the transfer belt 9*a* in such a manner as to face the four photoconductor drums 1*a* to 1*d*, respectively, and to be in contact with the transfer belt 9*a*. The transfer members 5*a* to 5*d* are connected with an unshown power supply for transfer bias. The transfer members 5 apply a positive charge to the sheet S through the transfer belt 9*a*. With the resulting electric field, the negatively charged toner images in the respective colors on the photoconductor drums 1 are sequentially transferred to the sheet S that is in contact with the photoconductor drums 1, whereby a color image is formed. A fixing unit 10 for fixing on the sheet the toner images transferred to the sheet is provided above the transfer belt 9*a*. A pair of discharge rollers 11 and 12 for discharging the sheet having the image formed thereon to a discharge portion 13 is provided above the fixing unit 10.

A feed unit 8 that feeds a sheet from a stack of sheets placed therein is provided at the bottom of the image forming apparatus 100. The feed unit 8 includes a pair of feed rollers 8*a* that feeds a sheet toward the transfer belt 9*a*. A pair of conveying rollers 91, which is a pair of rotatable members including a driving roller 19 and a conveying roller 18, is provided between the pair of feed rollers 8*a*, which form a conveying section conveying a sheet, and the transfer belt 9*a*. The pair of feed rollers 8*a* and the pair of conveyance rollers 91 form part of a sheet conveying device that conveys a sheet while correcting any obliquity of the sheet. The detailed configuration of the sheet conveying device will be described separately below.

Reference numeral 15 denotes a duplex conveyance path that connects the pair of discharge rollers 11 and 12 and the pair of conveying rollers 91. Oblique conveying rollers 16 and a U-turn roller 17 are provided in the duplex conveyance path 15.

The sheet S fed by the pair of feed rollers 8*a* of the feed unit 8 is conveyed to the transfer belt 9*a* by the pair of conveying rollers 91. While the sheet is conveyed by the transfer belt 9*a*, the toner images formed on the photoconductor drums 1*a* to 1*d* are sequentially transferred to the sheet by the operation of the transfer members 5*a* to 5*d*. The sheet having the toner images transferred thereto undergoes image fixing in the fixing unit 10 and is discharged to the discharge portion 13 by the pair of discharge rollers 11 and 12.

To form images on both sides of the sheet, the pair of discharge rollers 11 and 12 are rotated backward while the sheet is conveyed by the pair of discharge rollers 11 and 12, whereby the sheet is conveyed into the duplex conveyance path 15 by the pair of discharge rollers 11 and 12. The sheet S conveyed into the duplex conveyance path 15 passes the oblique conveying rollers 16 and is conveyed to the transfer belt 9*a* again by the U-turn roller 17 and the pair of conveying rollers 91. Subsequently, an image is formed on a second side of the sheet.

The configuration of the sheet conveying device according to this embodiment integrally included in the image forming apparatus 100 will now be described with reference to perspective views of the sheet conveying device shown in FIGS. 2 and 3.

Pairs of conveying rollers 91 include driving rollers 19 and conveying rollers 18. The driving rollers 19 are fixed on a driving shaft 19*a* extending parallel to the direction of the axes of rotation of the photoconductor drums 1. The driving shaft 19*a* is rotatably supported by a feed frame 20. A rotational driving force from an unshown motor is transmitted to the driving shaft 19*a*, whereby the driving rollers 19 rotate.

The conveying rollers 18 are arranged in the axial direction. The conveying rollers 18 are rotatably supported by the feed frame 20. The conveying rollers 18 are in contact with the driving rollers 19, respectively, whereby nips are formed. The sheet is conveyed while being nipped between the conveying rollers 18 and the driving rollers 19.

Figure 2:
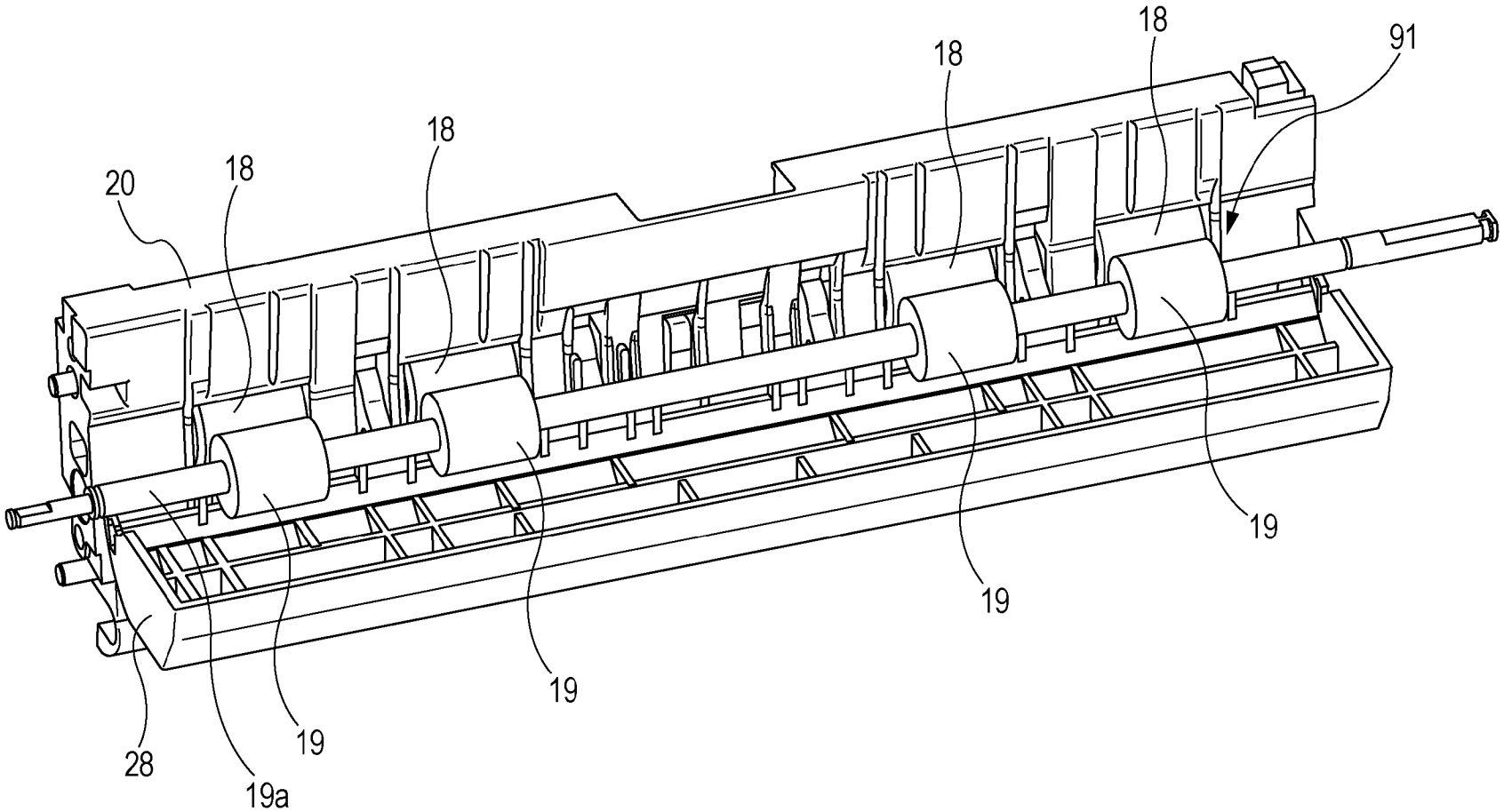
FIG. 2 is a perspective view showing the configuration of a sheet conveying device according to the first embodiment.
Figure 3:
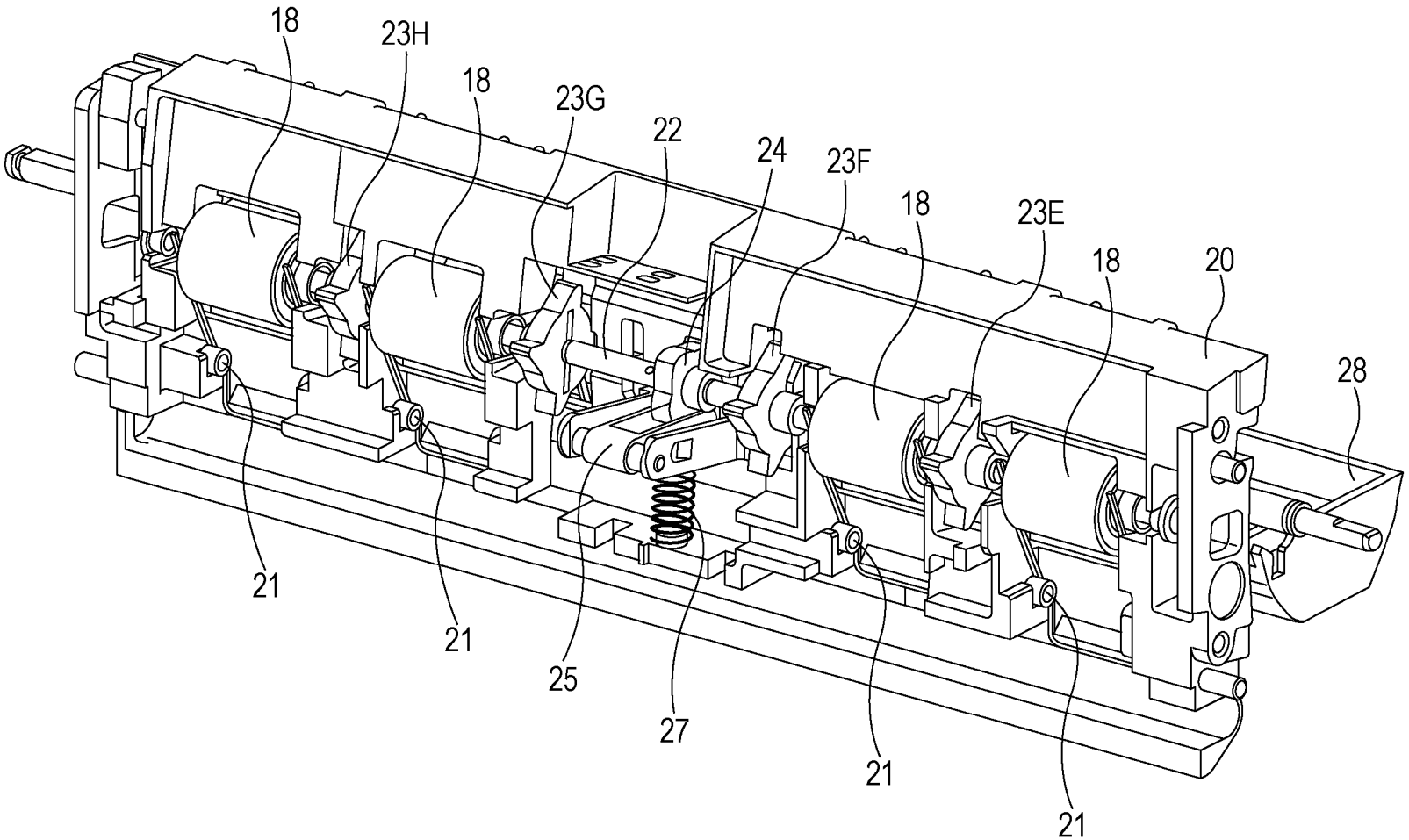
FIG. 3 is another perspective view showing the configuration of the sheet conveying device according to the first embodiment.

As shown in a perspective view in FIG. 3 seen from the other side of the view in FIG. 2, shutter members 23 (23E, 23F, 23G, and 23H) are fixed on a shutter shaft 22, which extends parallel to the driving shaft 19*a*, in such a manner as to be in phase with each other (with the same positional relationship relative to the shutter shaft 22). The shutter shaft 22, functioning as the axis of rotation of the shutter members 23, is rotatably supported by the feed frame 20. The conveying rollers 18 have through-holes, respectively, therein passing therethrough in the axial direction. The shutter shaft 22 extends through the through-holes of the conveyance rollers 18. Hence, the center of rotation of the conveying rollers 18 coincides with the center of rotation of the shutter shaft 22. A shutter cam 24, described in detail separately below, is fixed on the shutter shaft 22 at the axial-direction center of the shutter shaft 22. The shutter members 23 and the shutter cam 24 both fixed on the shutter shaft 22 rotate together with the shutter shaft 22.

The conveying rollers 18 are movably supported by the feed frame 20 and are urged against the driving rollers 19 by conveying roller springs 21 in such a manner as to be press-contactable with the driving rollers 19. The conveying roller springs 21 are fixed to the feed frame 20. In the state where the conveying rollers 18 are urged against the driving rollers 19, gaps are provided between the outer peripheral surface of the shutter shaft 22 and the inner peripheral surfaces defining the through-holes of the conveying rollers 18. Therefore, the spring forces of the conveying roller springs 21 are not transmitted to the shutter shaft 22. Hence, the spring forces of the conveying roller springs 21 do not prevent the rotational motions of the shutter members 23 and the shutter cam 24 both integrally fixed on the shutter shaft 22.

The shutter members 23, functioning as blocking members, each have four bumper surfaces 23*a*, 23*b*, 23*c*, and 23*d* provided at regular intervals in the peripheral direction. The bumper surfaces 23*a*, 23*b*, 23*c*, and 23*d* can block the sheet S by coming into contact with the leading end of the sheet S immediately before the sheet S enters the nips between the driving rollers 19 and the conveying rollers 18. The bumper surfaces 23*a*, 23*b*, 23*c*, and 23*d*, functioning as blocking surfaces, are provided such that, before the leading end of the sheet S comes into contact with the shutter members 23 at the relevant bumper surfaces, these bumper surfaces are positioned on the upstream side with respect to the nips between the driving rollers 19 and the conveying rollers 18 and block the leading end of the sheet that is being conveyed.

Figure 4A:
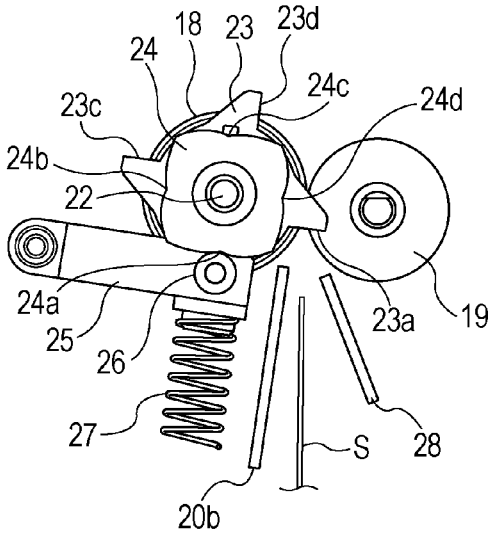
FIGS. 4A, 4B, 4C, and 4D are diagrams that illustrate the behavior of the sheet conveying device according to the first embodiment.

The shutter cam 24 will now be described. The shutter cam 24 determines the position of the shutter members 23 in the rotating direction and sets the bumper surfaces 23*a*, 23*b*, 23*c*, and 23*d* of the shutter members 23 to be at such appropriate positions as to block the leading end of the sheet. As shown in FIG. 4A, the shutter cam 24 has a square shape in side view with the corners thereof defined by arcs and with concave portions 24*a*, 24*b*, 24*c*, and 24*d* formed in the respective sides thereof. The shutter cam 24 is pressed by a pressing member 25. The pressing member 25 is supported by the feed frame 20 in such a manner as to be swingable about an axis of swing. The pressing member 25 is urged against the shutter cam 24 by a shutter spring 27 having one end thereof fixed to the feed frame 20 and the other end thereof fitted to the pressing member 25.

As shown in cross-sectional views in FIGS. 4A to 4D, the pressing member 25 has at the tip thereof a cam follower 26 supported in such a manner as to be rotatable with respect to the pressing member 25. The cam follower 26 is constantly in contact with the shutter cam 24.

According to such a configuration, while the cam follower 26 urges the shutter cam 24 with the spring force of the shutter spring 27, the shutter members 23 are retained in a standby position (standby state) in the rotating direction, as shown in FIG. 4A. When the shutter members 23 are in the standby position, the cam follower 26 is positioned at the concave portion 24*a* of the shutter cam 24. That is, the cam follower 26 urged with the spring force of the shutter spring 27 is in contact with the concave portion 24*a* of the shutter cam 24. Therefore, the shutter members 23 are retained in the standby position with the spring force of the shutter spring 27. Thus, the cam follower 26 urged by the shutter spring 27, the portions 24*a*, 24*b*, 24*c*, and 24*d* of the shutter cam 24, and so forth form a positioning unit that positions the shutter members 23 to be in a steady position. The positioning unit applies an urging force to the shutter members 23 to be in a steady position. When the shutter members 23 are in the standby position, shown in FIG. 4A, which is an orientation for blocking the leading end of the sheet, any of the bumper surfaces 23*a*, 23*b*, 23*c*, and 23*d* of each of the shutter members 23 is positioned on the upstream side in the conveyance direction with respect to a corresponding one of the nips between the driving rollers 19 and the conveying rollers 18.

In the cross-sectional views shown in FIGS. 4A to 4D, reference numeral 28 denotes a right conveyance guide that guides the right side of the sheet that is conveyed toward the pair of conveying rollers 91, and reference numeral 20*b* denotes a left conveyance guide that guides the left side of the sheet.

In this embodiment, the shutter shaft 22, the shutter members 23, and the shutter cam are molded as separate members, and the shutter members 23 and the shutter cam 24 are fixed on the shutter shaft 22. Alternatively, the shutter members, the shutter cam, and the shutter shaft may be provided as an integral resin molding.

The behavior of the sheet conveying device will now be described with reference to FIGS. 4A to 7.

Figure 6:
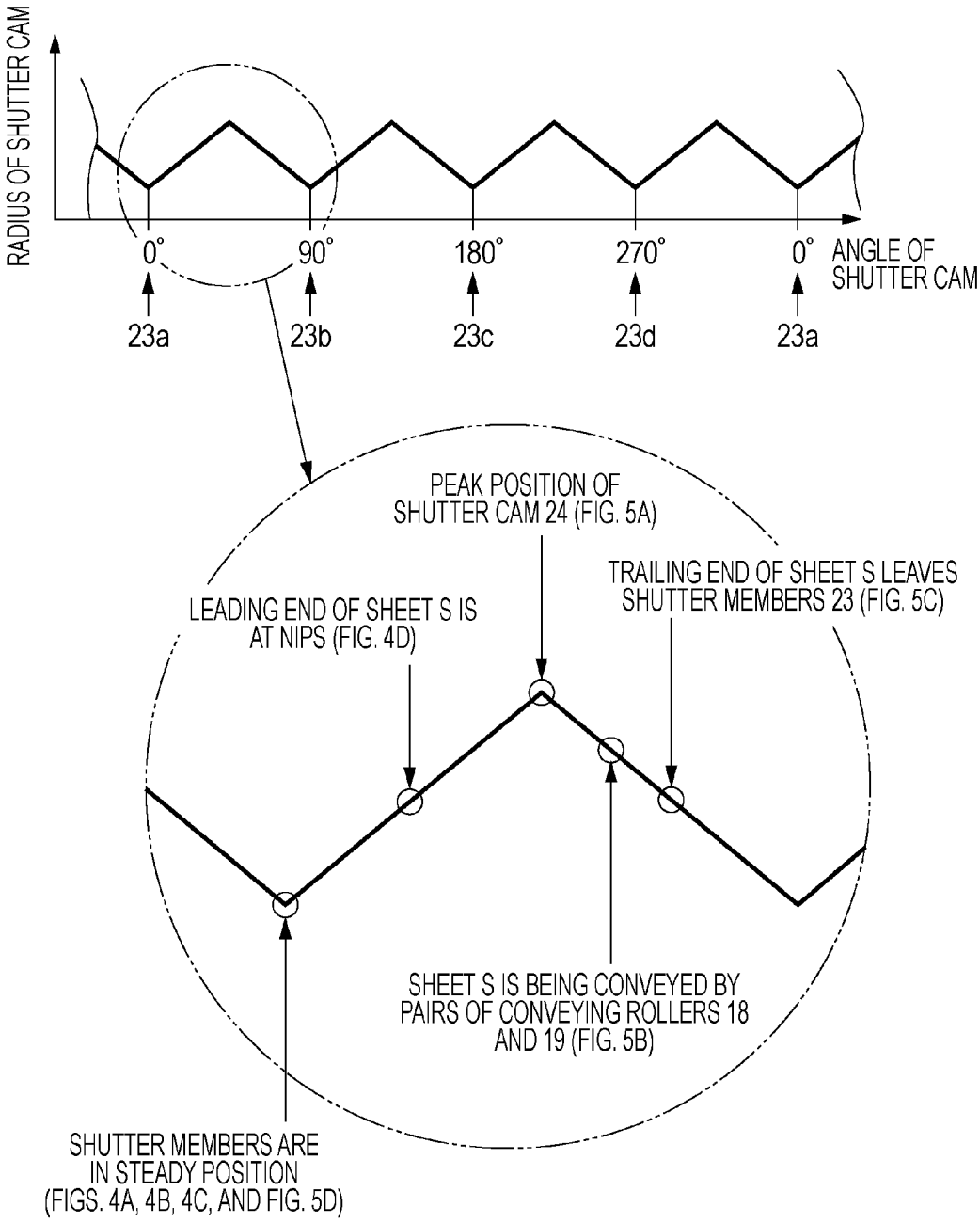
FIG. 6 is a cam chart of the sheet conveying device according to the first embodiment.
Figure 7:
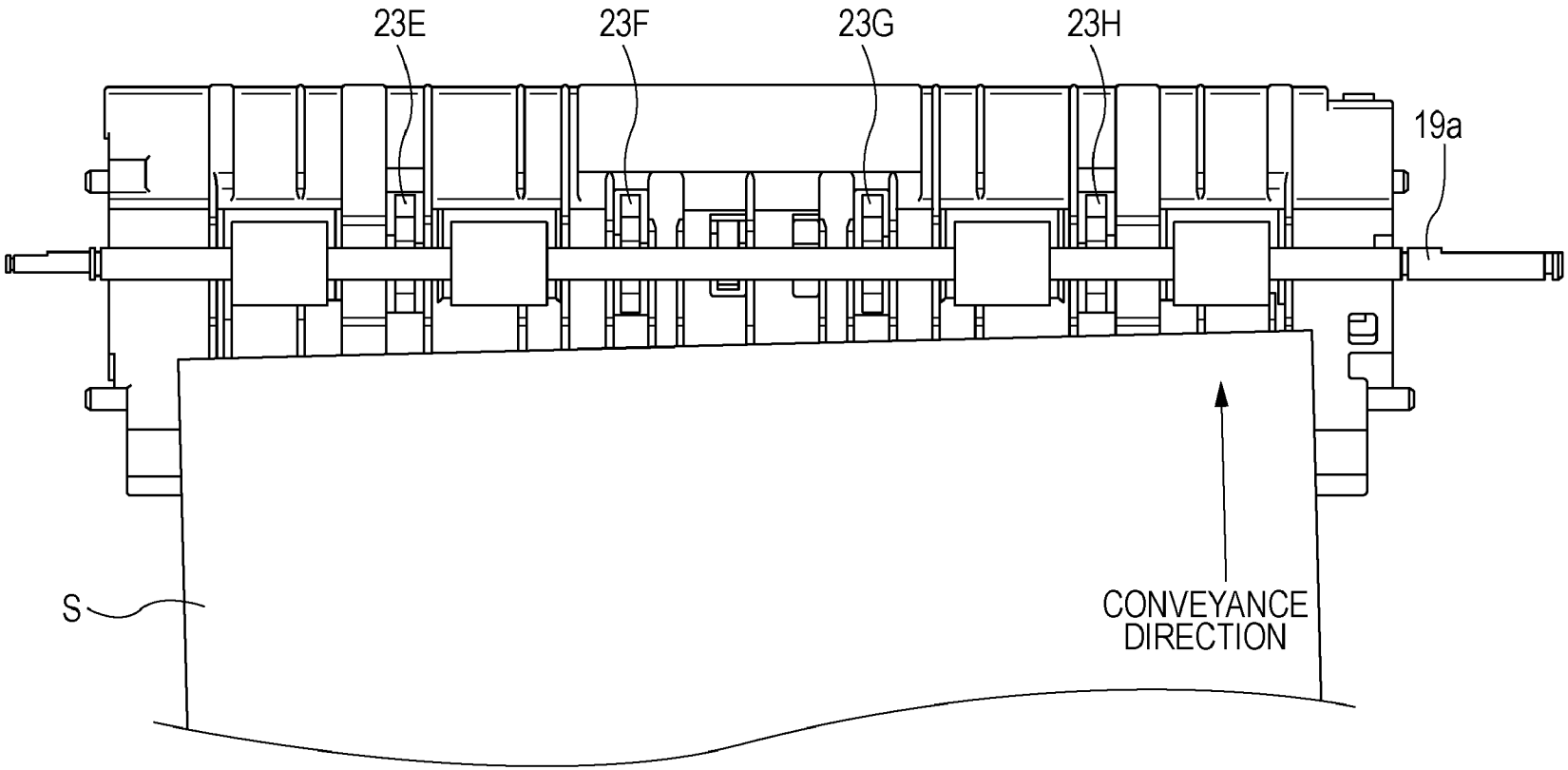
FIG. 7 is a plan view showing the configuration of the sheet conveying device according to the first embodiment.

FIGS. 4A to 5D, showing cross sections of the sheet conveying device, show a process in which a sheet is conveyed while any obliquity thereof is corrected. FIG. 6 is a cam chart of the shutter cam 24 representing the states shown in FIGS. 4A to 5D. FIG. 7 shows a state of a sheet S obliquely advancing toward the pairs of conveying rollers 91.

Suppose that, for example, a sheet S conveyed by the feed unit 8 obliquely advances toward the pairs of conveying rollers 91 as shown in FIG. 7. If the sheet S is conveyed in the oblique state and reaches the image forming section, the image to be transferred to the sheet S is formed obliquely with respect to the sheet S. Therefore, in this embodiment, any obliquity of the sheet is corrected by the shutter members 23 provided near the driving rollers 19 and the conveying rollers 18 before an image is formed on the sheet.

FIG. 4A shows a state immediately before the leading end of a sheet comes into contact with the bumper surfaces 23*a* of the shutter members 23. In this state, the shutter cam 24 subjected to the urging force of the shutter spring 27 stands by in a standby position for aligning the leading end of the sheet. The sheet S in this state has not come into contact with the bumper surfaces 23*a* yet. Therefore, as mentioned above, the bumper surfaces 23*a* of the shutter members are positioned on the upstream side with respect to the nips of the pairs of conveying rollers 91.

Subsequently, when the leading end of the sheet comes into contact with the bumper surfaces 23*a*, the sheet S receives a reactive force produced by the retaining force of the shutter cam 24 urged by the shutter spring 27 and inertial forces, acting as reactive forces, of the shutter shaft 22 and the shutter members 23 and the shutter cam 24 both fixed on the shutter shaft 22. In this embodiment, in the state shown in FIG. 4B where the leading end of the sheet has just come into contact with the bumper surfaces 23*a*, the leading end of the sheet S does not push and rotate the shutter members 23 against the reactive forces.

Figure 4C:
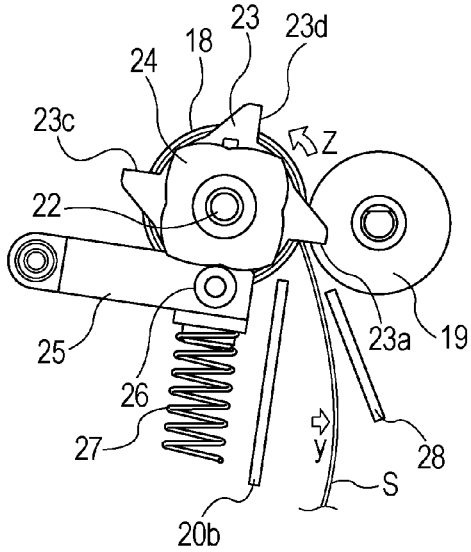
Figure 4B:
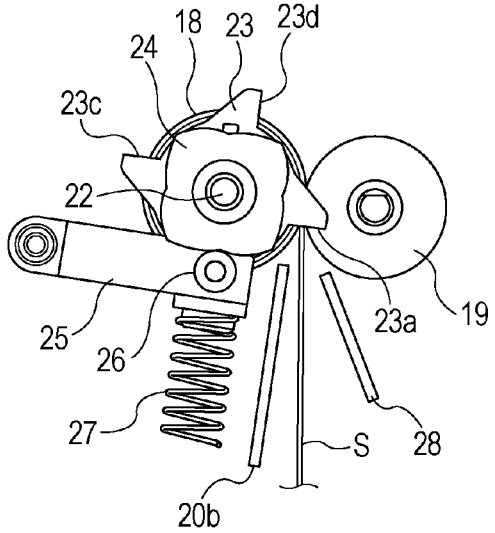

When the pair of feed rollers 8*a* of the feed unit 8 further convey the sheet S, a loop is formed near the leading end of the sheet as shown in FIG. 4C, whereby the leading end of the sheet is aligned with the bumper surfaces 23*a* of the shutter members 23.

The behavior occurring when the leading end of the sheet is aligned with the bumper surfaces 23*a* of the shutter members 23 will now be described in detail. Specifically, a portion of the leading end of the sheet S advancing ahead in the sheet width direction is blocked in such a state as to be in contact with the bumper surface 23*a* of a corresponding one of the shutter members 23. Subsequently, portions of the leading end of the sheet S following behind in the sheet width direction sequentially come into contact with and are blocked by the bumper surfaces 23*a* of the other shutter members 23, respectively. More specifically, in the example shown as a top view in FIG. 7, the right side of the leading end of the sheet S advances ahead. In such a case, as the sheet is conveyed, the leading end of the sheet comes into contact with the shutter members 23 in the order of 23H, 23G, 23F, and 23E. In this process, a loop curving to project in the direction of an arrow y as shown in FIG. 4C is gradually formed in the sheet S. The loop formed in the sheet S curves more significantly on the right side, in FIG. 7, than on the left side.

Figure 4D:
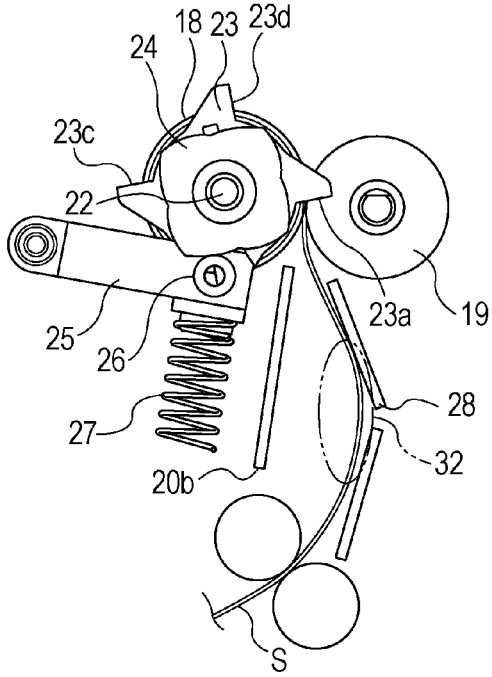

With the above series of movements, the leading end of the sheet S is aligned with the bumper surfaces 23*a* of the shutter members 23, whereby the leading end of the sheet becomes parallel to the axis of rotation of the pairs of conveying rollers 91. Furthermore, after a specific loop is formed in the sheet S in a sheet conveyance path defined by the right conveyance guide 28 and the left conveyance guide 20*b*, the shutter members 23 rotate about the shutter shaft 22 in the direction of an arrow z shown in FIG. 4C with a specific degree of stiffness (hardness) of the sheet S. Then, the shutter members 23 and the shutter cam 24 further rotate as shown in FIGS. 4D and 6, and the leading end of the sheet S is nipped at the nips between the driving rollers 19 and the conveying rollers 18 and is conveyed. Here, the more significantly the loop of the sheet formed in the sheet conveyance path curves, the higher the degree of obliquity correctability becomes, the sheet conveyance path being defined by the right conveyance guide 28 and the left conveyance guide 20*b*, which is part of the feed frame 20. Hence, as shown in FIG. 4D, a large loop forming space 32 is desirably provided. Furthermore, in this embodiment, the stiffness of the sheet S appears to be increased when the loop of the sheet formed in the loop forming space 32 comes into contact with the right conveyance guide 28. This increases the force with which the sheet S presses the bumper surfaces 23*a*. Thus, the shutter members 23 are assuredly moved against the urging force of the shutter spring 27.

The embodiment described above concerns a case where the shutter members 23 do not swing at the time the right side of the leading end of the sheet has just come into contact with a corresponding one of the shutter members 23, but the shutter members 23 start to swing when the left side of the leading end of the sheet has also come into contact with a corresponding one of the shutter members 23. Alternatively, the leading end of the sheet may be aligned with the bumper surfaces such that, while a portion of the leading end of the sheet that is in contact with a corresponding one of the shutter members 23 is causing the shutter member 23 to swing, the other portions of the leading end of the sheet sequentially come into contact with the bumper surfaces of the other shutter members 23 and are aligned therewith. Any obliquity can also be corrected with such a setting of the spring force of the shutter spring 27.

Subsequently, the shutter members 23 and the shutter cam 24 are further rotated by the leading end of the sheet S that is being conveyed by the driving rollers 19 and the conveying rollers 18. With the rotation of the shutter members 23 and the shutter cam 24, referring now to FIG. 5A, the point at which the cam follower 26 is positioned on the shutter cam 24 is shifted to go over a peak (a corner) of the shutter cam 24 (see FIG. 6). When the point has gone over the peak of the shutter cam 24, an additional rotational force in the direction of the arrow z, which is the same direction as that in which the shutter members 23 are pushed and rotated by the sheet, acts on the shutter members 23 in response to a rotational force produced by the shutter cam 24 and the shutter spring 27. That is, while the shutter members 23 are pushed by the leading end of the sheet S that is being conveyed by the driving rollers 19 and the conveying rollers 18, the direction in which the urging force of the shutter spring 27 acts on the shutter members 23 is changed by the action of the shutter cam 24.

Figure 5A:
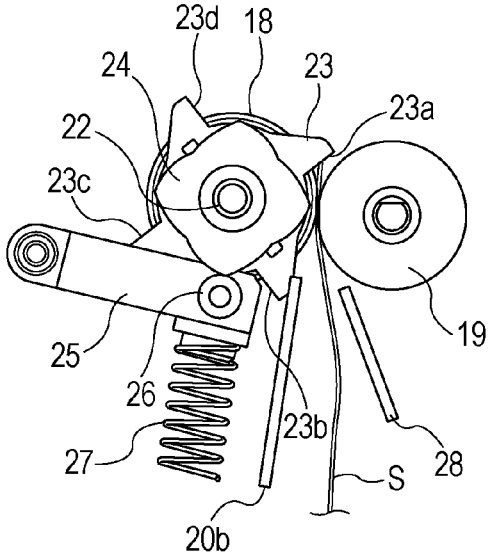
FIGS. 5A, 5B, 5C, and 5D are other diagrams that illustrate the behavior of the sheet conveying device according to the first embodiment.
Figure 5C:
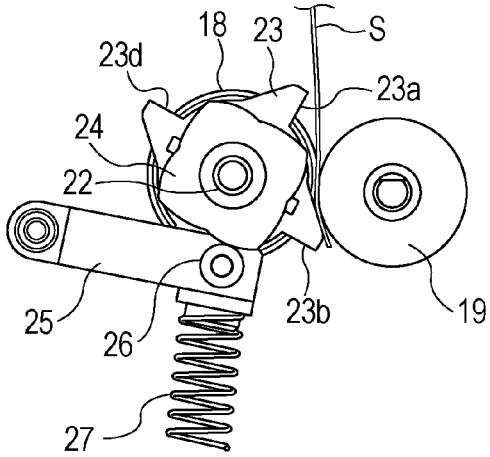
Figure 5B:
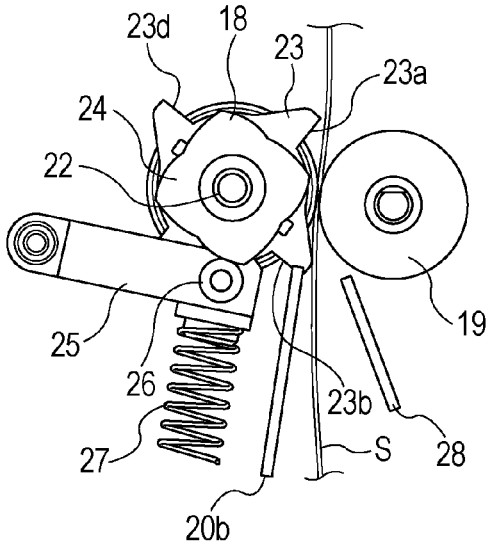

Then, with the urging force of the shutter spring 27, the state of the shutter members 23 changes from the state shown in FIG. 5A to a state shown in FIG. 5B, which is a sheet-passage-allowing orientation, where the sheet S is being conveyed by the conveying rollers 18 and the driving rollers 19. The shutter members 23 in this state are each subjected to the rotational force produced by the shutter cam 24 and the shutter spring 27 and acting in the direction of the arrow z, and the shutter members 23 are each retained in such a state that a convex portion thereof having the bumper surface 23*b* is in contact with the sheet S that is being conveyed. In this state, the sheet S that is being conveyed is stretched between the pair of feed rollers 8*a* on the upstream side and the nips of the conveying rollers 18 and the driving rollers 19. Therefore, the apparent stiffness of the sheet S that is being conveyed is high.

After the trailing end of the sheet S has passed the pair of feed rollers 8*a* on the upstream side, the apparent stiffness of the sheet S is reduced. Therefore, after the trailing end of the sheet S has passed the pair of feed rollers 8*a*, the balanced state (FIG. 5B) between the force that causes the shutter members 23 to rotate with the urging force of the shutter spring 27 and the stiffness of the sheet is gradually lost. Then, the shutter members 23 gradually rotate in the direction of the arrow z together with the shutter cam 24 and the shutter shaft 22.

Figure 5D:
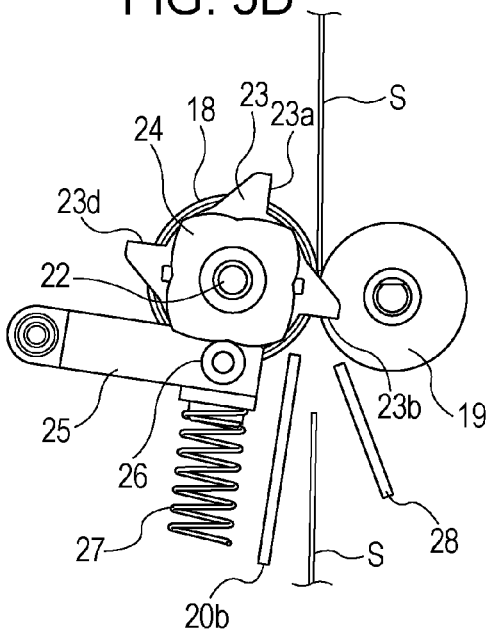

FIG. 5C shows a state where the trailing end of the sheet S is leaving the shutter members 23. When the trailing end of the sheet S has left the shutter members 23, the shutter members 23 rotate in the same direction as the conveyance direction in which the sheet is conveyed, and the bumper surfaces 23*b* stand by at the standby position, as shown in FIG. 5D, for aligning the leading end of the subsequent sheet S. Since the bumper surfaces 23*b* move to the standby position along with the movement of the trailing end of the sheet S, the sheet interval can be made much shorter than in the conventional case.

By repeatedly producing the states shown in FIGS. 4A to 5D as described above, the shutter members 23 and the shutter cam 24 both fixed on the shutter shaft 22 rotate together with the shutter shaft 22. Furthermore, while sheets S are sequentially conveyed, the bumper surfaces that stand by near the nips of the pairs of conveying rollers 91 change in the order of 23*a*, 23*b*, 23*c*, 23*d*, and 23*a*. The leading end of each newly conveyed sheet S is blocked by the relevant bumper surfaces, whereby any obliquity of each of the sheets S is corrected.

In this embodiment, the time from when the trailing end of a sheet has left the shutter members 23 until when the shutter members 23 move to be in the standby position for aligning the leading end of another sheet with the subsequent bumper surfaces thereof can be reduced. This is because the shutter members 23 rotate in the sheet conveyance direction from the state (FIG. 5B) where the sheet is conveyed with the surface thereof being in contact with the shutter members 23 to the standby position (FIG. 5D). This allows the bumper surfaces of the shutter members to quickly return to a home position for aligning the leading end of the subsequent sheet so that a higher sheet conveyance speed and a shorter sheet interval are realized. Thus, the demand from users for further improvement of throughput in sheet conveyance can be met.

Depending on the number of sheets conveyed, the bumper surfaces of the shutter members may be scraped because the leading ends of sheets bump against the bumper surfaces. By providing a plurality of bumper surfaces for each of the shutter members as in this embodiment, the scraping of the bumper surfaces can be reduced.

Figure 9A:
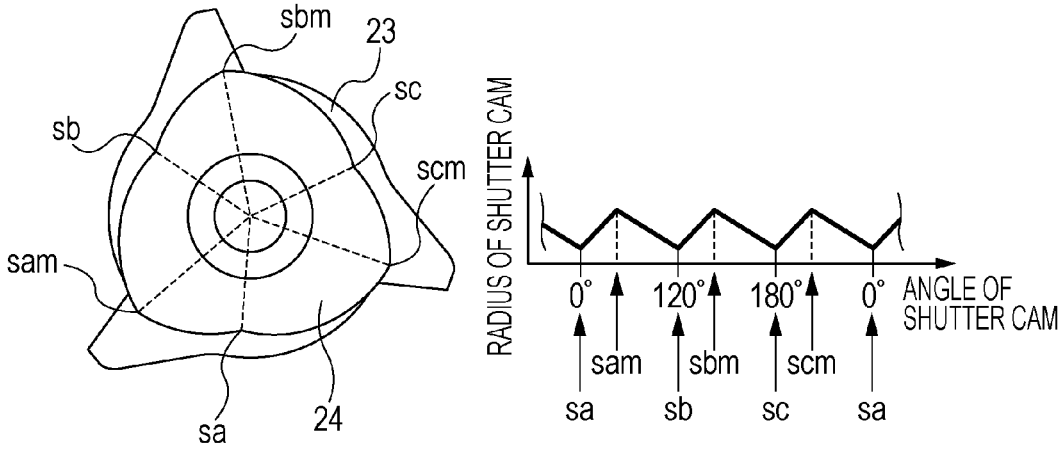
FIGS. 9A, 9B, and 9C are cross-sectional views showing variations of a shutter member included in the sheet conveying device according to the first embodiment.
Figure 9B:
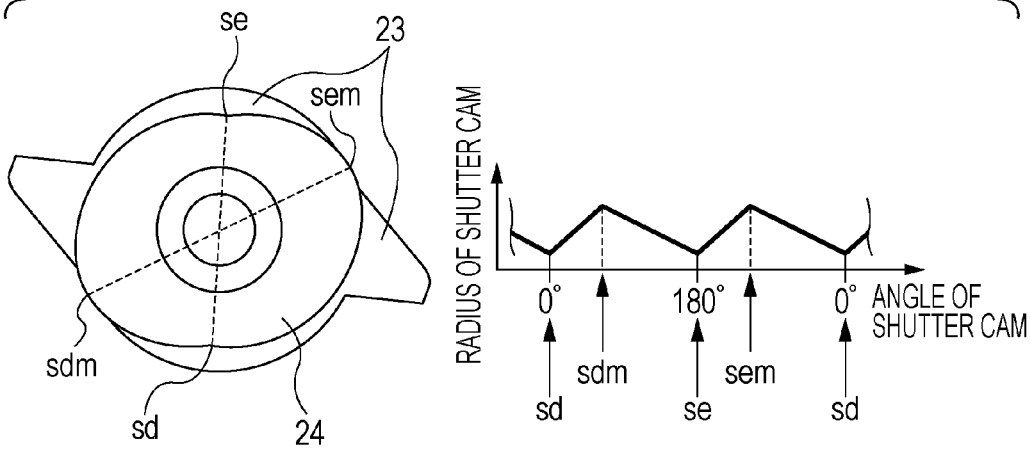
Figure 9C:
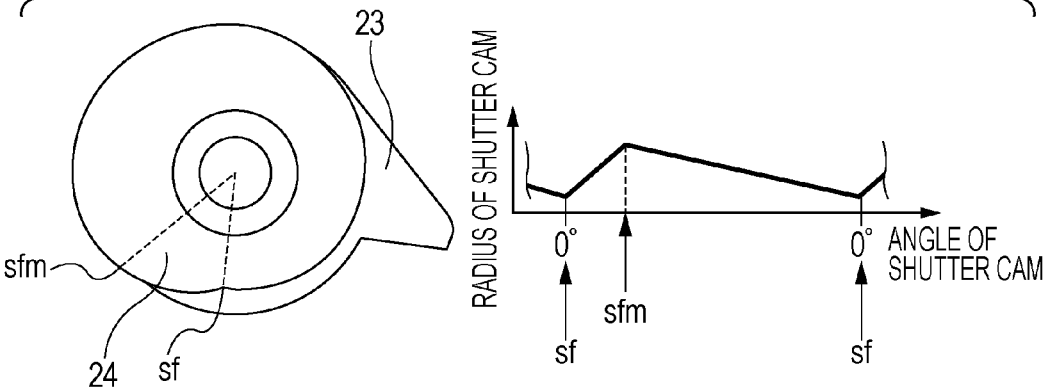

Although the above embodiment employs a configuration in which each shutter member 23 has four bumper surfaces, the same advantageous effect can be produced by other configurations in which one to three bumper surfaces are provided in accordance with the tolerable levels of the number of conveyable sheets that are required in individual sheet conveying devices. The shapes of the shutter members 23 and the shutter cams 24 in such configurations are shown in FIGS. 9A to 9C. FIGS. 9A to 9C show shutter members 23 having one to three bumper surfaces and shutter cams 24 corresponding thereto, and cam charts in the respective configurations.

Referring to FIG. 9A, when the cam follower is in contact with any of positions on the outer periphery of the shutter cam 24 denoted by reference characters sa, sb, and sc, the shutter member 23 is in the standby position. Reference characters sam, sbm, and scm denote the peak positions where the radius of the shutter cam 24 is the longest. The radius of the shutter cam 24 gradually becomes shorter in each of portions of the cam member defined by the positions on the outer peripheral surface from sam to sb, from sbm to sc, and from scm to sa. Referring to FIG. 9B, when the cam follower is in contact with either of positions on the outer periphery of the shutter cam 24 denoted by reference characters sd and se, the shutter member 23 is in the standby position. Reference characters sdm and sem denote the peak positions where the radius of the shutter cam 24 is the longest. The radius of the shutter cam 24 gradually becomes shorter in each of portions of the cam member defined by the positions on the outer peripheral surface from sdm to se and from sem to sd. Referring to FIG. 9C, when the cam follower is in contact with a position on the outer periphery of the shutter cam 24 denoted by reference character sf, the shutter member 23 is in the standby position. Reference character sfm denotes the peak position where the radius of the shutter cam 24 is the longest. The radius of the shutter cam 24 gradually becomes shorter in a portion of the cam member defined by the positions on the outer peripheral surface from sfm to sf. The behaviors occurring during sheet conveyance in the variations are the same as that in the above case where four bumper surfaces are provided, and descriptions thereof are therefore omitted.

Figure 8:
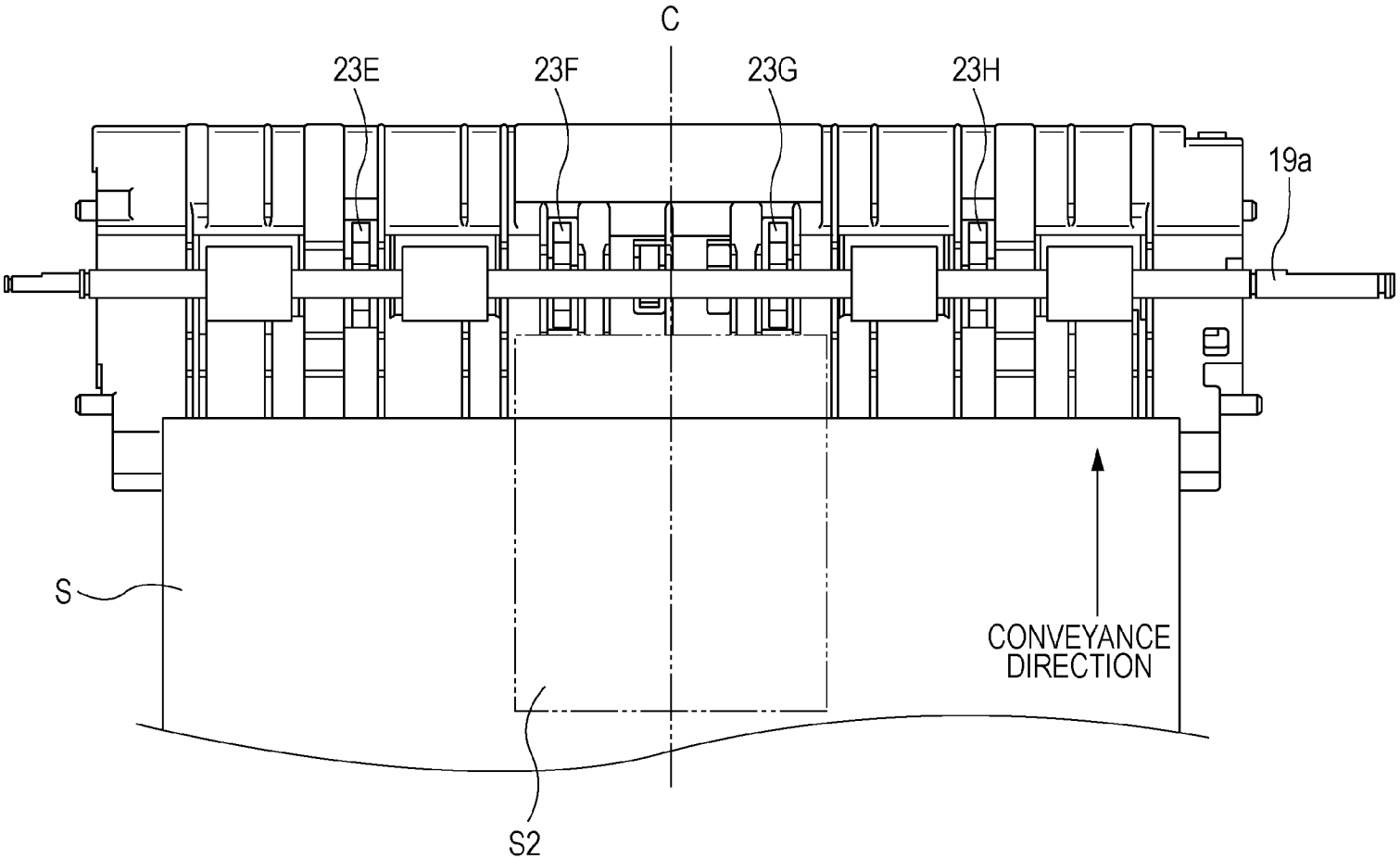
FIG. 8 is a plan view showing how the sheet conveying device according to the first embodiment handles different sheet widths.

Referring now to FIG. 8, in a case where the sheet S that is to be conveyed has a relatively large dimension in the widthwise direction orthogonal to the sheet conveyance direction (the sheet S shown by a solid line in FIG. 8), two shutter members 23E and 23H provided at positions corresponding to both side ends of the sheet mainly act on the leading end of the sheet.

In a case where the sheet to be used has a relatively small width that does not cover the shutter members 23E and 23H (the sheet S2 shown by a dashed line in FIG. 8), any obliquity of the sheet S is corrected by the shutter members 23F and 23G provided closer to the center than the shutter members 23E and 23H.

By providing the shutter members 23F and 23G, the contact pressure produced at the bumper surfaces where the leading end of the sheet comes into contact with the shutter members can be reduced. This prevents the occurrence of local dents in the sheet having a relatively large width produced when the leading end of the sheet comes into contact with the shutter members.

To obtain more precise correctability for any obliquity of the sheet S, the distance between the shutter members 23 corresponding to the width of the sheet S is preferably as long as possible, and the shutter members 23 are preferably arranged substantially symmetrically with respect to the center in the widthwise direction of the sheet S. This is because the error in the angle of correction of the leading end of the sheet S with respect to the direction of the axis of rotation of the driving rollers 19 is to be reduced.

Considering the above, shutter members 23 are preferably provided at positions corresponding to both side ends of the sheet S to be conveyed. Furthermore, to enable the correction of any obliquity of a sheet S having a relatively small width, additional shutter members 23 are preferably provided near the center C in the widthwise direction of the sheet S. That is, a plurality of shutter members 23 are preferably provided in the widthwise direction. Here, the distance between the two shutter members 23F and 23G that are nearest to and on both sides of the widthwise center C is set to be smaller than the minimum width of the sheet S to be used in the image forming apparatus. In this case, it is also preferable that the bumper surfaces of the shutter members 23F and 23G provided near the widthwise center be positioned on the downstream side in the sheet conveyance direction with respect to those of the shutter members 23E and 23H provided near both ends in the widthwise direction.

It is also preferable that the distance between the relevant one of the bumper surfaces 23*a*, 23*b*, 23*c*, and 23*d* of each shutter member 23 in the standby position and the corresponding nip between the driving roller 19 and the conveying roller 18 be as short as possible as in this embodiment. Thus, immediately before the leading end of the sheet S is taken into and nipped at the nips between the driving rollers 19 and the conveying rollers 18, the leading end of the sheet S is blocked by bumping against relevant ones of the bumper surfaces 23*a* to 23*d*, whereby any obliquity of the sheet S is corrected. According to such a configuration, immediately after any obliquity of the sheet S is corrected by the shutter members 23, the sheet S is nipped at the nips between the driving rollers 19 and the conveying rollers 18 and is conveyed. Therefore, while the effect of correction of any obliquity of the sheet by the shutter members 23 produced when the leading end of the sheet bumps against the shutter members 23 is maintained, the leading end of the sheet can be nipped between the driving rollers 19 and the conveying rollers 18 more assuredly.

It is also preferable that a plurality of bumper surfaces with which the shutter members come into contact with the leading end of the sheet be arranged in the direction orthogonal to the sheet conveyance direction and substantially symmetrically with respect to the widthwise center of the sheet. In such a case, more precise correctability for any obliquity of the sheet can be obtained. Furthermore, the occurrence of local dents in the sheet produced when the sheet comes into contact with the shutter members 23 can be prevented.

Second Embodiment

A second embodiment of the sheet conveying device and an image forming apparatus including the same according to the present invention will now be described with reference to FIGS. 10 to 12B. Herein, configurations different from those in the first embodiment are only described, and configurations identical with those in the first embodiment are denoted by the corresponding reference numerals, whereby descriptions thereof are omitted.

Figure 10:
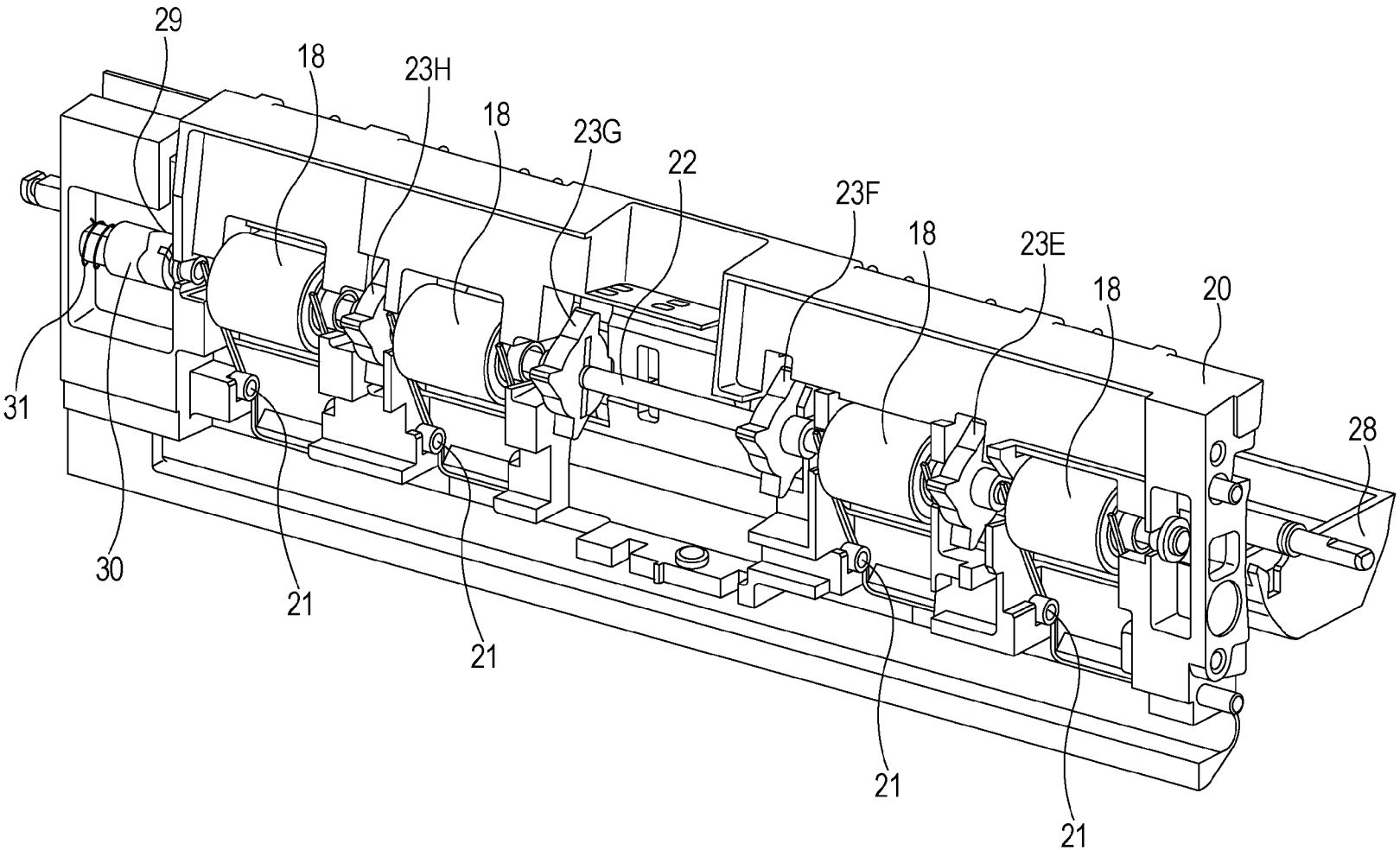
FIG. 10 is a perspective view showing the configuration of a sheet conveying device according to a second embodiment.

FIG. 10 is a perspective view showing a configuration according to the second embodiment. In the first embodiment, the retaining force and rotational force of the shutter shaft 22 are produced by using a cam formed so that the cam acts in the radial direction with respect to the shutter shaft 22. In contrast to this, the second embodiment differs from the first embodiment in that the retaining force and rotational force of the shutter shaft 22 are produced by using a cam formed so that the cam acts in the thrust direction with respect to the shutter shaft 22, as shown in FIG. 10.

Figure 11A:
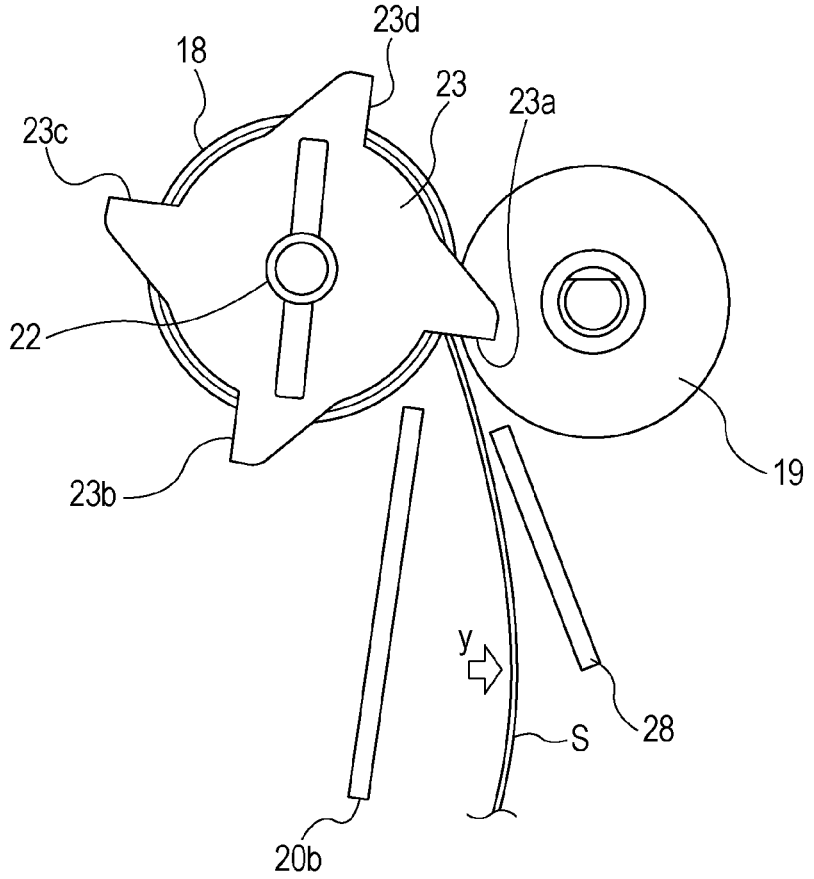
FIG. 11A is a cross-sectional view showing the behavior of the sheet conveying device according to the second embodiment.

The configuration according to the second embodiment will first be described with reference to the perspective view shown in FIG. 10, a cross-sectional view shown in FIG. 11A, and an enlarged perspective view of a rotating cam shown in FIG. 11B. A rotating cam 29 is fixed to an end of the shutter shaft 22 with a spring pin or the like. The rotating cam 29 rotates together with the shutter shaft 22 and the shutter members 23.

Figure 11B:
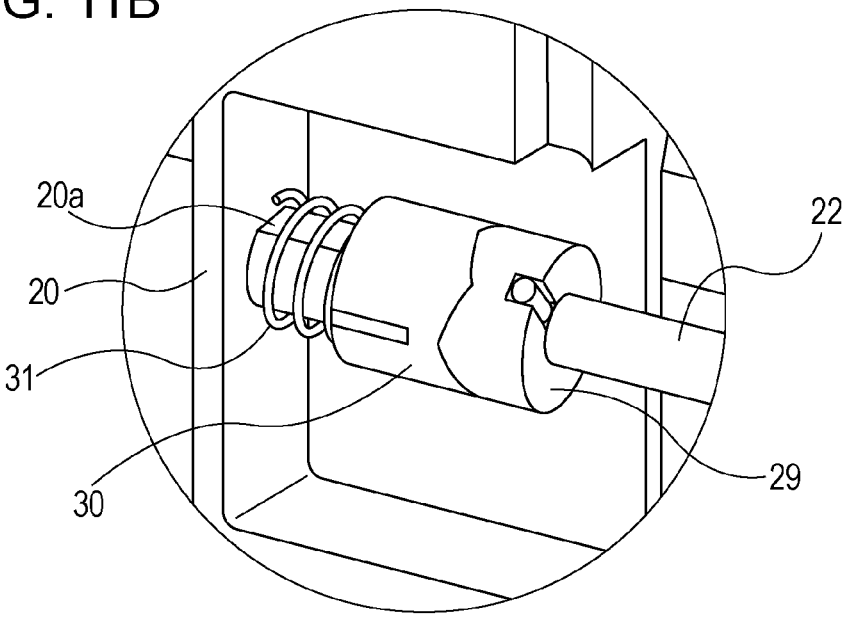
FIG. 11B is a perspective view showing the behavior of the sheet conveying device according to the second embodiment.

Meanwhile, as shown in FIG. 11B, a sliding cam 30 is provided on the cam shaft 20*a* in such a manner as to be slidable in the axial direction along and to be prevented from rotating by a cam shaft 20*a* having an oval cross section and provided on the feed frame 20. A pressing spring 31 is provided on the cam shaft 20*a* and between the feed frame 20 and the sliding cam 30. The pressing spring 31 urges the sliding cam 30 in the axial direction toward the rotating cam 29. The sliding cam 30 is limited to be movable within a specific range in the axial direction by an unshown stopper provided on the cam shaft 20*a*.

The behavior occurring in the second embodiment will now be described with reference to FIGS. 11A to 12B. FIGS. 11A and 11B show a state where the leading end of the sheet S has come into contact with the bumper surfaces 23*a* of the shutter members 23 and, while a loop projecting in the direction of the arrow y is being formed in the sheet S, the leading end of the sheet S is gradually aligned in the axial direction of the pairs of conveying rollers 91. In this state, the shutter members 23 are retained with an urging force of the pressing spring 31 that urges the cam surfaces of the rotating cam 29 and the sliding cam 30 fixed coaxially with the shutter members 23, the cam surfaces acting in the thrust direction. As in the first embodiment, a loop is formed in the sheet S in the sheet conveyance path defined by the right conveyance guide 28 and the left conveyance guide 20*b* provided near and on the upstream side with respect to the pairs of conveying rollers 91.

Figure 12A:
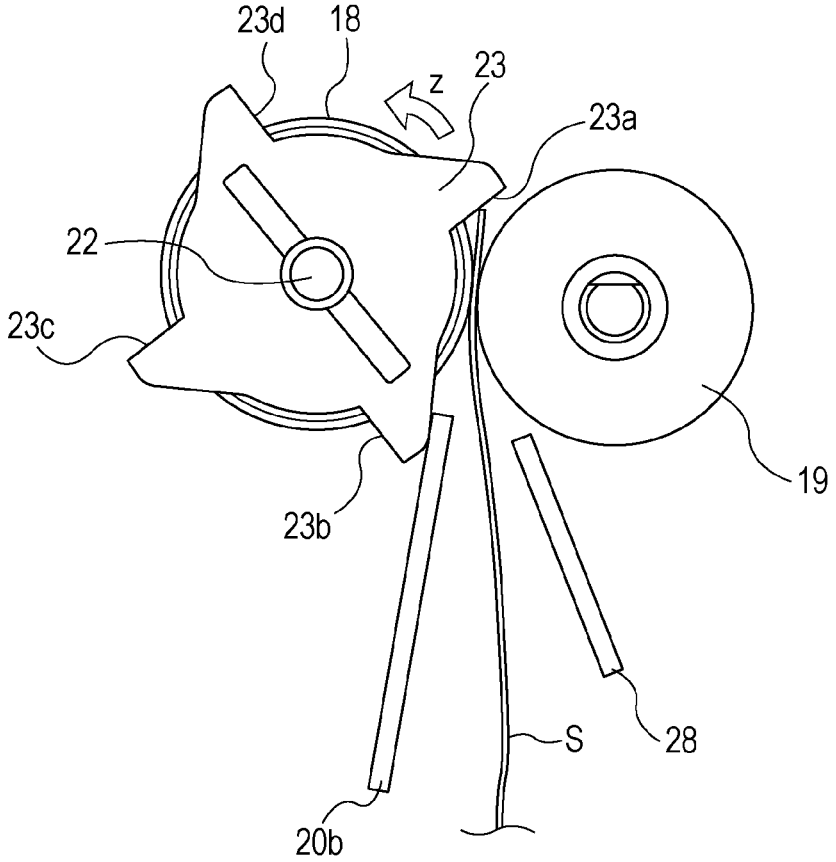
FIG. 12A is another cross-sectional view showing the behavior of the sheet conveying device according to the second embodiment.

A force that rotates the shutter members 23 and the rotating cam 29 about the shutter shaft 22 in the direction of the arrow z shown in FIG. 12A is produced with a specific degree of stiffness of the sheet S. When the rotating cam 29 rotates with such a stiffness of the sheet S, referring now to FIG. 12B, the sliding cam 30 slides in the direction of an arrow x while compressing the pressing spring 31.

Figure 12B:
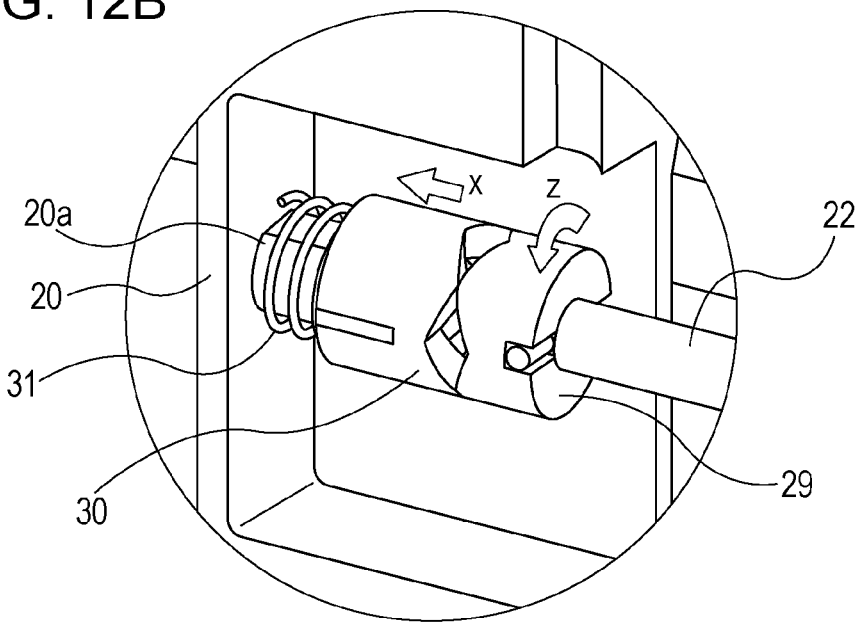
FIG. 12B is another perspective view showing the behavior of the sheet conveying device according to the second embodiment.

When the shutter members 23 and the rotating cam 29 further rotate, the leading end of the sheet S is nipped at the nips between the driving rollers 19 and the conveying rollers 18 and is conveyed. The sheet S conveyed with the conveyance force of the conveying rollers 18 and the driving rollers 19 causes the shutter members 23 and the rotating cam 29 to further rotate. Subsequently, as shown in FIG. 12B, the points at which the rotating cam 29 and the sliding cam 30 are in contact with each other are shifted to go over the peaks of the rotating cam 29 and the sliding cam 30. When the contact points between the rotating cam 29 and the sliding cam 30 have gone over the peaks of the rotating cam 29 and the sliding cam 30, the shutter members 23 further rotate in the direction of the arrow z with the rotational force produced by the rotating cam 29, the sliding cam 30, and the pressing spring 31. Meanwhile, the sliding cam 30 slides in the direction opposite to the direction of the arrow x shown in FIG. 12B. In a state where the sheet is being conveyed by the driving rollers 19 and the conveying rollers 18 with the surface thereof being in contact with the shutter members 23, the sheet is further conveyed.

When the trailing end of the sheet S has left the shutter members 23, the shutter members 23 rotate to be in the standby position again for aligning the leading end of the subsequent sheet (the leading end of the subsequent sheet is to come into contact with the bumper surfaces 23*b*), as in the first embodiment. Here, the rotating cam 29, the sliding cam 30, and the pressing spring 31 are in the state shown in FIG. 11B again.

By repeatedly producing the states described above, the shutter members 23 and the rotating cam 29 both fixed on the shutter shaft 22 rotate together with the shutter shaft 22. Furthermore, while sheets S are sequentially conveyed, the bumper surfaces that are positioned near the nips of the pairs of conveying rollers 91 change in the order of 23*a*, 23*b*, 23*c*, 23*d*, and 23*a*, as in the first embodiment. The leading end of each newly conveyed sheet S comes into contact with the relevant bumper surfaces, whereby any obliquity of each of the sheets S is corrected.

Advantageous effects produced in the first and second embodiments will now be summarized.

The retaining force acting to retain the shutter members 23 to be in the standby position and required for aligning the leading end of the sheet with the shutter members 23 is produced by the shutter spring 27 or the pressing spring 31, which is urging means, through the intermediary of the shutter cam 24 or the rotating cam 29. With this force, the leading end of the sheet is blocked by the shutter members 23, and a loop is formed in the sheet. With the loop formed in the sheet, the leading end of the sheet is aligned with the shutter members 23.

When the degree of stiffness of the sheet becomes higher than the degree of the retaining force of the shutter spring 27 or the pressing spring 31 that operates to retain the shutter members to be in the standby position, the sheet causes the shutter members 23 to rotate. While a state where the leading end of the sheet is in contact with the shutter members 23 is maintained, the leading end of the sheet is nipped by the pairs of conveying rollers 91. Since the leading end of the sheet is nipped by the pairs of conveying rollers 91 while the state where the leading end of the sheet is in contact with the shutter members 23 is maintained, the sheet nipped by the pairs of conveying rollers 91 has any obliquity thereof corrected.

The loop forming space 32 defined by the right conveyance guide 28 and the left conveyance guide 20*b* is provided on the upstream side in the conveyance direction with respect to the shutter members 23. With the loop forming space 32, a loop is easily formed in the sheet after the leading end of the sheet is blocked by the shutter members 23. On the upstream side with respect to the shutter members 23, there are variations in the sheet conveyance speed because of contact resistances produced by the conveyance guides and acting on the sheet that is being conveyed, component tolerances of the pair of feed rollers 8*a*, and so forth. Even in such a case where there are variations in the sheet conveyance speed, the difference in the sheet conveyance speed seen on the upstream side in the sheet conveyance direction with respect to the shutter members 23 is eliminated in the loop forming space 32 that realizes easy formation of a loop in the sheet, and a loop necessary for obliquity correction is formed in the sheet. Moreover, since the looped portion of the sheet comes into contact with the right conveyance guide 28 defining the loop forming space 32, the sheet can have a sufficient degree of strength required for the leading end thereof to rotate the shutter members 23. Therefore, such kinds of failure are prevented that the shutter members 23 are rotated by the sheet not having a sufficient loop and that the shutter members 23 cannot be rotated even by the sheet having a specific stiffness and a jam occurs.

When the trailing end of the sheet passes the shutter members 23, the shutter members 23 that have been in the sheet conveyance orientation (see FIG. 5B) rotate in the sheet conveyance direction and return to be in the orientation for blocking the leading end of the sheet, i.e., the standby position (see FIG. 5D). Therefore, the time from when the trailing end of the sheet has passed the shutter members 23 until when the shutter members 23 return to be in the standby position is short. Consequently, the throughput in sheet conveyance (the number of sheets conveyable per unit time) can be increased.

The spring force of the shutter spring 27 or the pressing spring 31 is utilized for causing the shutter members 23 in the state where the leading end of the sheet is in contact therewith (FIG. 5A) to rotate to be in the sheet-passage-allowing orientation in which the shutter members 23 are in contact with the surface of the sheet (FIG. 5B). The spring force of the shutter spring 27 or the pressing spring 31 is also utilized for causing the shutter members 23 in the sheet-passage-allowing orientation in which the shutter members 23 are in contact with the surface of the sheet that is being conveyed by the pairs of conveying rollers 91 (FIG. 5B) to rotate to be in the standby position (FIG. 5D). Thus, a simple and reasonable configuration is provided.

Gaps are provided between the outer peripheral surface of the shutter shaft 22 provided for the shutter members 23 and the inner peripheral surfaces defining the through-holes of the conveying rollers 18. Therefore, the spring forces of the conveying roller springs 21 are not transmitted to the shutter shaft 22. Hence, the spring forces of the conveying roller springs 21 do not prevent the rotational motions of the shutter members 23 integrally fixed on the shutter shaft 22. Accordingly, the retaining force acting to retain the shutter members 23 to be in the standby position and required for aligning the leading end of the sheet with the shutter members 23 can be produced stably. Furthermore, the rotational force acting to rotate the shutter members in the same direction as the sheet conveyance direction and to bring the shutter members to be in the standby position quickly after the trailing end of the sheet has passed the shutter members can be produced stably.

Third Embodiment

A third embodiment of the sheet conveying device and an image forming apparatus including the same according to the present invention will now be described with reference to FIGS. 13 to 15B-2. Herein, configurations different from those in the first embodiment are only described, and configurations identical with those in the first embodiment are denoted by the corresponding reference numerals, whereby descriptions thereof are omitted.

The third embodiment differs from the first embodiment in that a detecting member 34 is provided on the shutter shaft 22 according to the first embodiment and a detection sensor 33 that detects the movement of the detecting member 34 is added.

Figure 13:
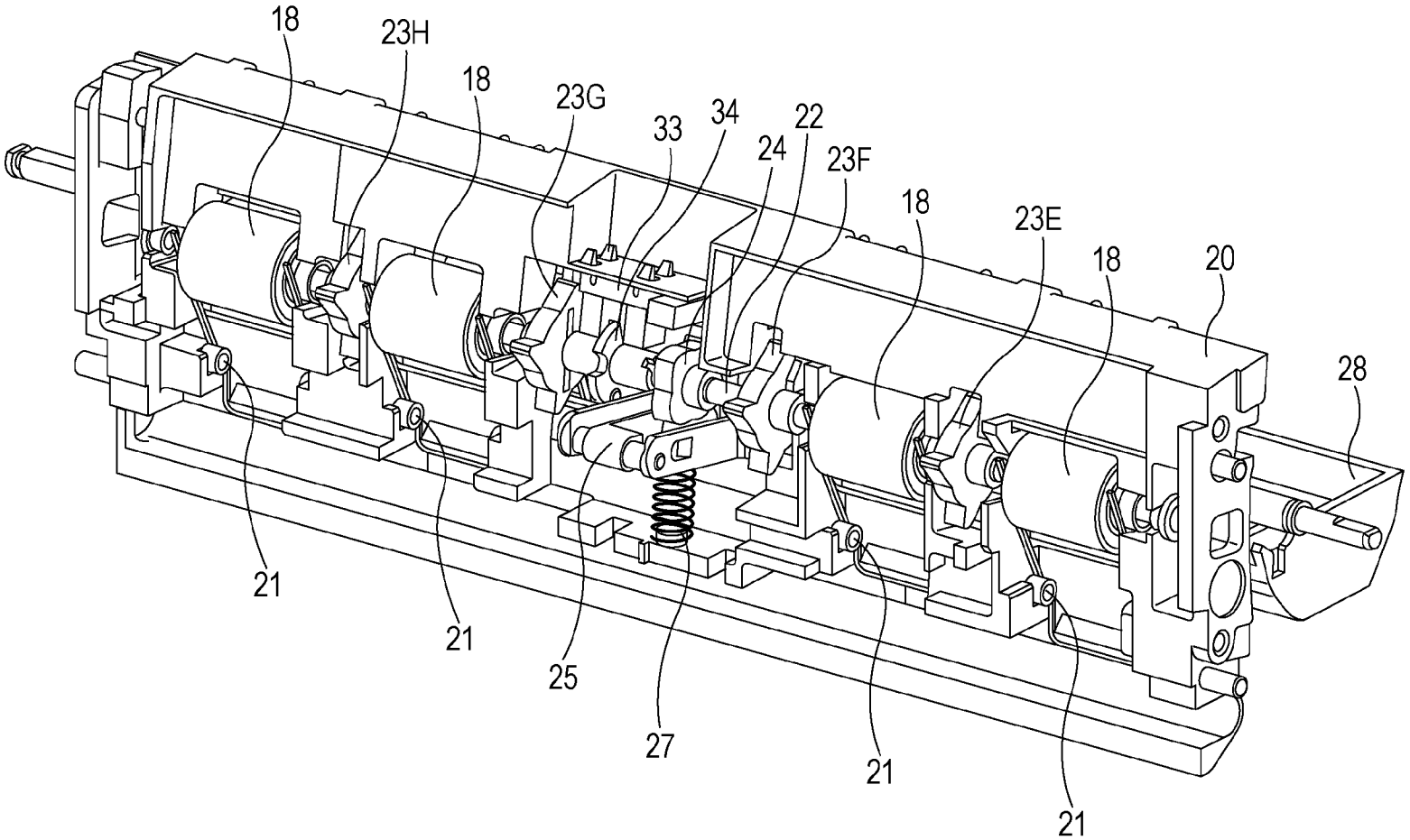
FIG. 13 is a perspective view showing the configuration of a sheet conveying device according to a third embodiment.

As shown in a perspective view in FIG. 13, the detecting member 34 is fixed on the shutter shaft 22 with a spring pin or the like. The detecting member 34 rotates together with the shutter shaft 22, the shutter members 23, and the shutter cam 24. The detection sensor 33 is an optical sensor that forms an optical path by including a light emitter and a photodetector, and is provided on the feed frame 20. The detection sensor 33 generates an ON or OFF signal in accordance with whether or not the optical path is intercepted by the detecting member 34.

Figure 14A:
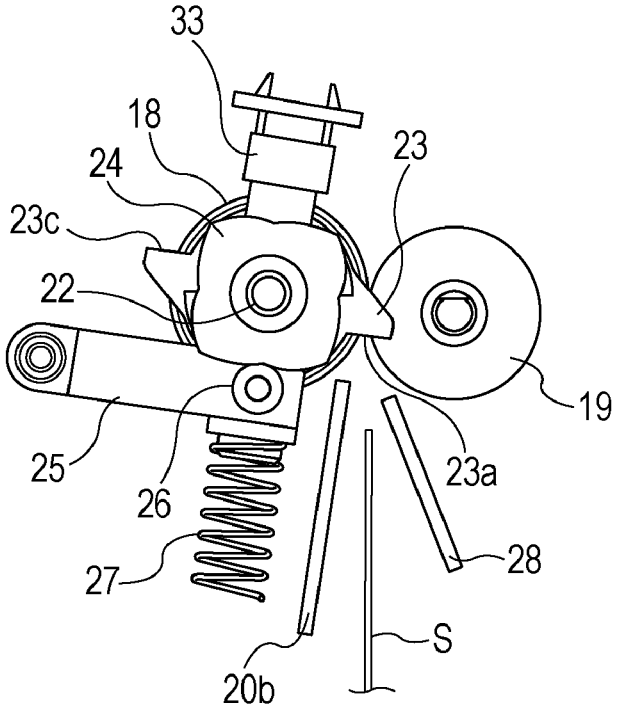
FIGS. 14A and 14B are cross-sectional views showing the behavior of the sheet conveying device according to the third embodiment.
Figure 14B:
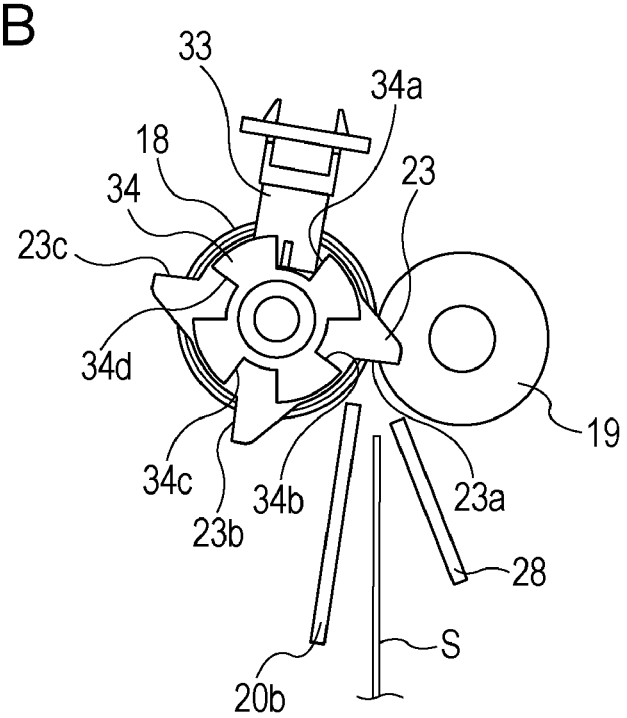

FIGS. 14A and 14B are cross-sectional views showing a state where the shutter members 23 are in the standby position. FIG. 14A shows the state of the shutter cam 24. FIG. 14B shows the configuration of the detecting member 34. The detecting member has a number of cuts corresponding to the number of bumper surfaces 23*a*, 23*b*, 23*c*, and 23*d*, provided in the peripheral direction, of each shutter member 23. The cuts correspond to the detection sensor 33.

The behavior occurring in the third embodiment will now be described with reference to FIGS. 14A to 15B-2.

FIGS. 14A and 14B show a state immediately before the leading end of a sheet comes into contact with the bumper surfaces 23*a* of the shutter members 23. The shutter members 23 and the detecting member 34 stand by in the standby position while being urged by the shutter cam 24, the pressing member 25, and the shutter spring 27. As shown in FIG. 14B, since the detection sensor 33 faces one of the cuts in the detecting member 34, the optical path of the detection sensor 33 is not intercepted by the detecting member 34, i.e., in a transmitted state.

Figures 1, 15A:
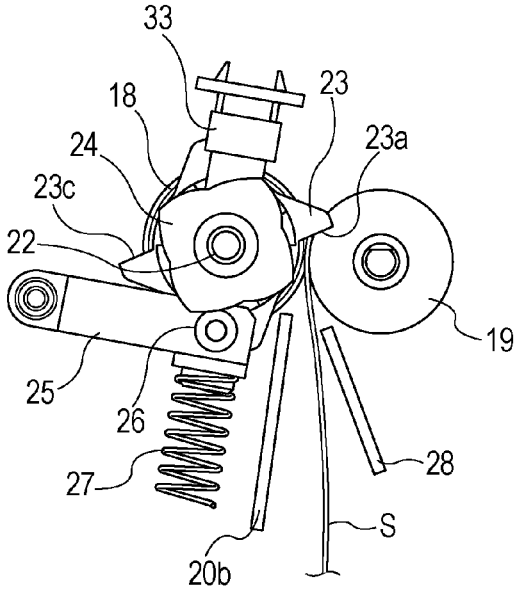
Figures 1, 15B:
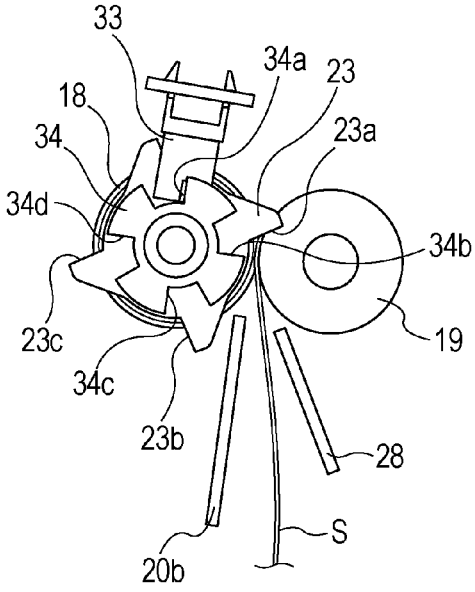
Figures 2, 15A:
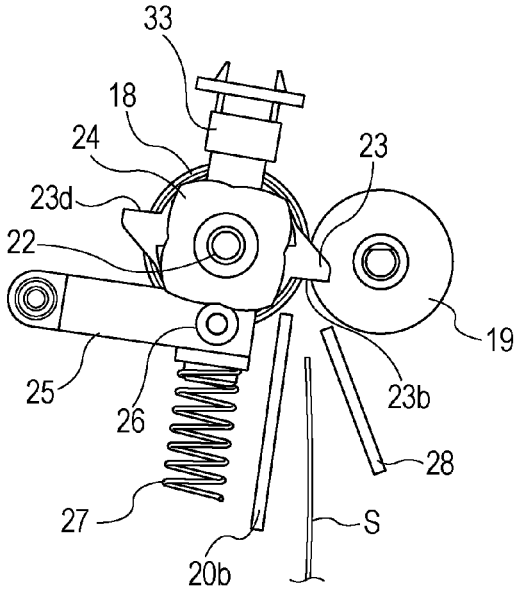
Figures 2, 15B:
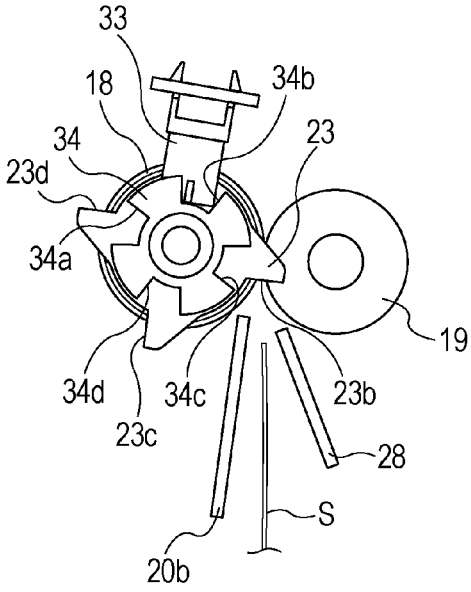

Subsequently, after the leading end of the sheet S that is being conveyed has come into contact with the bumper surfaces 23*a*, the leading end of the sheet S is nipped by the pairs of conveying rollers 91 and the sheet S starts to be conveyed by the pairs of conveying rollers 91, as shown in FIGS. 15A-1 and 15B-1. In this state, as shown in FIG. 15B-1, the detecting member 34 intercepts the optical path of the detection sensor 33. Specifically, a detecting surface 34*a* of the detecting member 34 that is rotating together with the shutter members 23 intercepts the optical path of the detection sensor 33. The interception of the optical path by the detecting member 34 switches the state of the detection sensor 33 between ON and OFF. Accordingly, the signal from the detection sensor 33 is switched between ON and OFF. Thus, the reaching of the leading end of the sheet S is detected. Here, the image forming section starts to form an image to be formed on the sheet at a point of time based on the information on the position of the leading end of the sheet.

Subsequently, as in the first embodiment, when the trailing end of the sheet S has left the shutter members 23, the shutter members 23 rotate to be in the standby position. The detecting member 34 stands by again, as are the shutter members 23, in the standby position shown in FIGS. 15A-2 and 15B-2, in which a detecting surface 34*b* is positioned for detecting the leading end of the subsequent sheet S. As sheets S are sequentially conveyed, the detecting surface changes sequentially in the order of 34*a*, 34*b*, 34*c*, and 34*d*. Each of the detecting surfaces detects the leading end of a newly fed sheet S, and image formation is performed sequentially in accordance with the detected signal.

As described above, the detecting member 34 behaves similarly to the shutter members 23 according to the first embodiment. Therefore, almost at the same time as the trailing end of a sheet S leaves the shutter members 23, the detecting member 34 can be in the standby position for detecting the leading end of the subsequent sheet S. Thus, even under the condition of a high sheet conveyance speed and with a short sheet interval, the detecting member 34 can return to the home position for detecting the leading end of the subsequent sheet. Accordingly, users' demands for more improved throughput of image forming apparatuses can be met.

The configuration described in the third embodiment in which the sheet that is being conveyed is detected by detecting the position of the shutter members with the detection sensor can also be applied to the second embodiment. Specifically, in the second embodiment, an intercepting member that intercepts the optical path of the detection sensor is provided on a shutter member 23. The intercepting member on the shutter member 23 is set in such a manner as not to intercept the optical path of the detection sensor when the shutter members 23 are in the standby position, and to intercept the optical path of the detection sensor 33 while the shutter members are rotating by being pushed by the sheet that is being conveyed by the pairs of conveying rollers 91.

This embodiment also produces the same advantageous effects as in the first and second embodiments. Moreover, this embodiment produces the following advantageous effect. Since the detecting member for turning the detection sensor 33 on and off moves in conjunction with the shutter members 23 so as to detect the sheet, the detecting member can be quickly positioned to be in the standby position for detecting the subsequent sheet.

Fourth Embodiment

A fourth embodiment of the sheet conveying device and an image forming apparatus including the same according to the present invention will now be described with reference to FIGS. 16A to 16C. Herein, configurations different from those in the first embodiment are only described, and configurations identical with those in the first embodiment are denoted by the corresponding reference numerals, whereby descriptions thereof are omitted.

Figure 16A:
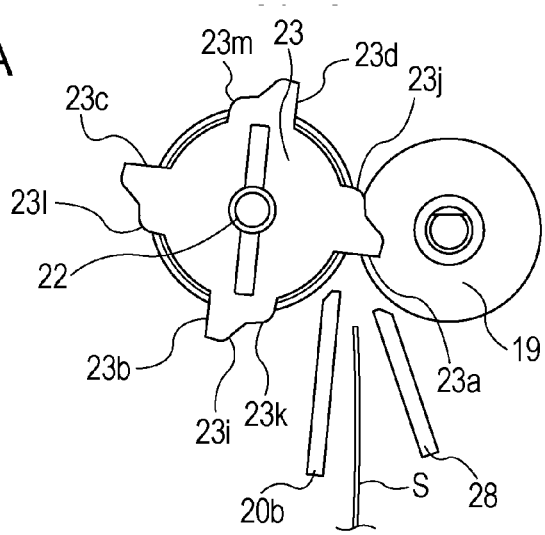
FIGS. 16A, 16B, and 16C are cross-sectional views showing the behavior of a sheet conveying device according to a fourth embodiment.
Figure 16B:
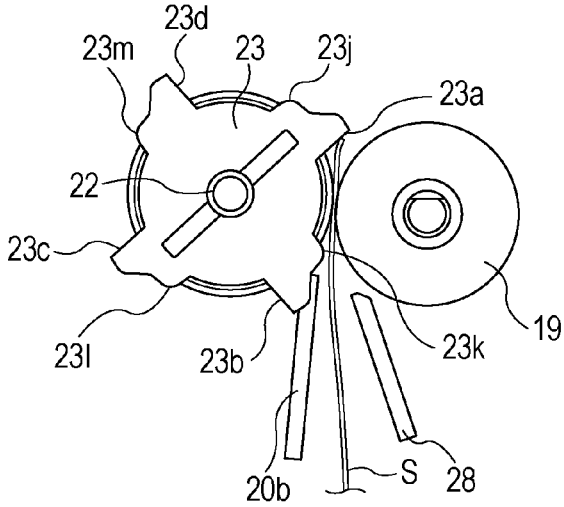
Figure 16C:
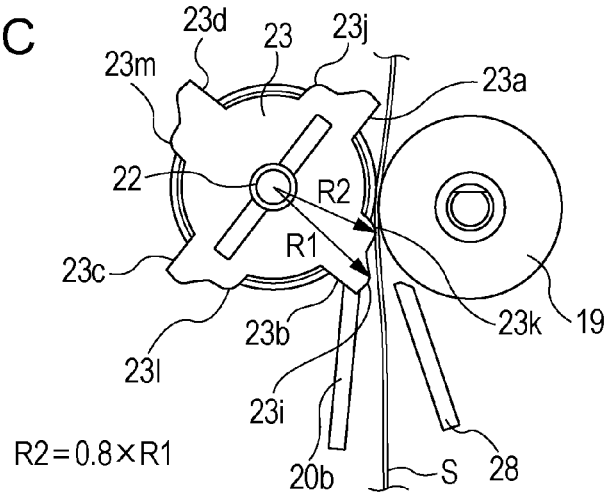

FIGS. 16A to 16C are cross-sectional views showing a configuration according to the fourth embodiment. The fourth embodiment differs from the first embodiment in the shape of the shutter members 23. In the fourth embodiment, each shutter member 23 has a convex portion 23*j*, with which the surface of the sheet is to come into contact, on the downstream side in the direction of rotation thereof with respect to the bumper surface 23*a*; a convex portion 23*k*, with which the surface of the sheet is to come into contact, on the downstream side in the direction of rotation thereof with respect to the bumper surface 23*b*; a convex portion 23*l*, with which the surface of the sheet is to come into contact, on the downstream side in the direction of rotation thereof with respect to the bumper surface 23*c*; and a convex portion 23*m*, with which the surface of the sheet is to come into contact, on the downstream side in the direction of rotation thereof with respect to the bumper surface 23*d*.

The projecting amount of the convex portions 23*j*, 23*k*, 23*l*, and 23*m* in the radial direction is smaller than the projecting amount of the portions having the bumper surfaces 23*a*, 23*b*,

23*c*, and 23*d* of the shutter member and forming the outermost portions on the contour of the shutter member in the radial direction. In addition, the convex portions 23*j*, 23*k*, 23*l*, and 23*m* projecting by the above amount in the radial direction extend more outward than the contour of the conveying roller 18. That is, the tops of the convex portions 23*j*, 23*k*, 23*l*, and 23*m* are positioned on the outer side of the contour of the conveying roller 18.

The behavior occurring in the fourth embodiment will now be described with reference to FIGS. 16A to 16C. The process in which a sheet is conveyed in the sheet conveyance direction is shown in the order of FIGS. 16A, 16B, and 16C.

FIG. 16A shows a state immediately before the leading end of a sheet comes into contact with the bumper surfaces 23*a* of the shutter members 23. In this state, the shutter members 23 are retained in the standby position. After the leading end of the sheet S has come into contact with the bumper surfaces 23*a*, the shutter members 23 rotate by being pushed by the sheet, and the sheet is nipped by the pairs of conveying rollers 91. This state where the sheet S starts to be conveyed by the pairs of conveying rollers 91 is shown in FIG. 16B. In the state shown in FIG. 16B, the shutter members 23 are in contact with the leading end of the sheet S at the bumper surfaces 23*a* thereof, whereas the convex portions 23*k* thereof are not in contact with the sheet S.

Subsequently, when the sheet is conveyed by the pairs of conveying rollers 91, the shutter members 23 that are in the state shown in FIG. 16B rotate counterclockwise with the rotational force of the shutter cam 24, and are oriented such that the convex portions 23*k* of the shutter members 23 are in contact with the surface of the sheet S as shown in FIG. 16C. This state is maintained until the trailing end of the sheet S leaves the convex portions 23*k*. After the trailing end of the sheet S has left the convex portions 23*k*, the shutter members 23 behave in the same way as in the first embodiment, and the convex portions 23*l*, 23*m*, and 23*j* sequentially come into contact with subsequent sheets S, respectively, as the sheets S are conveyed.

The advantageous effect brought by the convex portions 23*j*, 23*k*, 23*l*, and 23*m* added in the fourth embodiment will now be described. After the leading end of a sheet has come into contact with the bumper surfaces 23*a* of the shutter members 23, the shutter members 23 rotate with the rotational force of the shutter cam 24 and the shutter members 23 come into contact with the sheet S. The noise produced by the contact can be reduced compared to that in the first embodiment. The reason for this will be described below in detail.

In the first embodiment, when the shutter members 23 rotate with the rotational force of the shutter cam 24, the shutter members 23 each come into contact with the sheet S at a point (corresponding to an end portion 23*i* in FIG. 16C) thereof positioned on the opposite side of the bumper surface for the subsequent sheet, as shown in FIG. 5B. Here, the contact radius from the contact point between the sheet S and each shutter member 23 to the center of rotation of the shutter member 23 is denoted by R1, and the angular speed of the shutter member 23 at the contact point is denoted by $\omega 1$. Then, the speed V1 at which the shutter member 23 comes into contact with the sheet S is expressed as $V1=R1\cdot\omega 1$. In the first embodiment, each shutter member 23 comes into contact with the sheet S at the point where the radius of the shutter member 23 is the longest. Therefore, the shutter member 23 comes into contact with the sheet S at the point where the angular speed is the highest.

In contrast, in the fourth embodiment, each shutter member 23 comes into contact with the sheet S at the convex portion 23*k*. Here, the contact radius from the contact point (convex portion) between the sheet S and each shutter member 23 to the center of rotation of the shutter member 23 is denoted by R2, and the angular speed of the shutter member 23 at the contact point is denoted by $\omega 2$. Then, the contact speed V2 at which the shutter member 23 comes into contact with the sheet S is expressed as $V2=R2\cdot\omega 2$. The relationship between the contact radii in the first and fourth embodiments is such that the contact radius R2 is smaller than the contact radius R1 as shown in FIG. 16C. In this embodiment, the relationship is expressed as $R2=0.8\times R1$.

Figure 17:
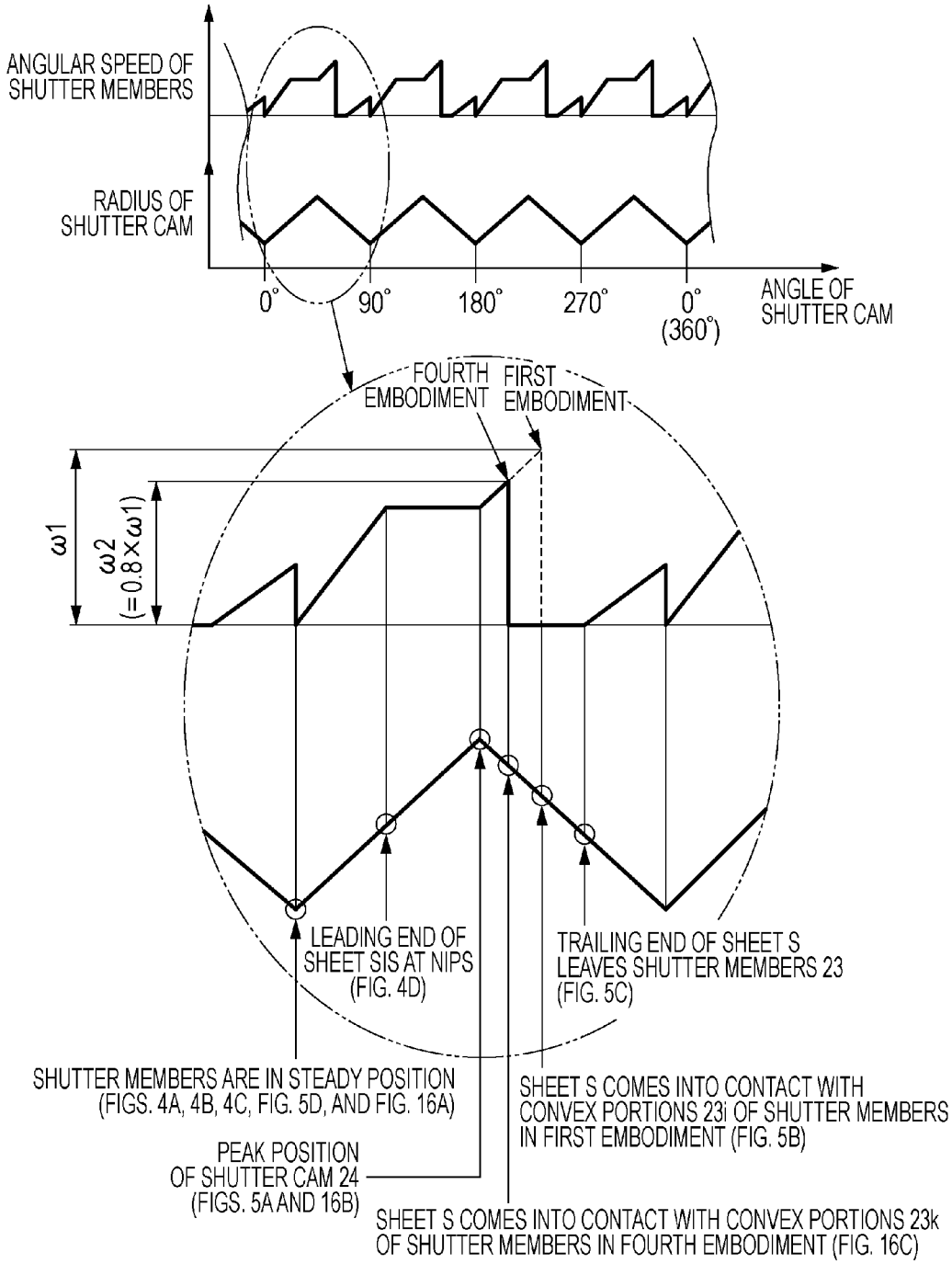
FIG. 17 is a cam chart of the sheet conveying device according to the fourth embodiment.

The angular speed will now be described with reference to FIG. 17. FIG. 17 shows the phase of rotation of the shutter cam 24 and the relationship between the angular speed of the shutter members 23 and the radius of the shutter cam 24 at relevant points in the phase. In FIG. 17, the behavior of the rotating cam in the first embodiment is also shown for the purpose of comparison.

As shown in FIG. 17, the angle of rotation of the shutter cam 24 from each peak position to a point where the shutter members 23 come into contact with the sheet S is smaller in the fourth embodiment than in the first embodiment. Here, the relationship between the angular speeds of the shutter members 23 is expressed as $\omega 2<\omega 1$. In the fourth embodiment, $\omega 2=0.8\times\omega 1$. Considering the foregoing facts, the contact speed at which the shutter members 23 come into contact with the sheet S is expressed as $V2<V1$. Hence, the speed V2 in this embodiment comes to 64% of V1 ($V2=0.8\cdot R1\times 0.8\cdot\omega 1=0.64V1$).

The contact energy E with which the shutter members 23 subjected to the rotational force of the shutter cam 24 come into contact with the sheet S is proportional to the second power of the contact speed. Hence, the relationship between the contact energy E1 in the first embodiment and the contact energy E2 in the fourth embodiment is expressed as $E2=0.41\cdot E1$. By adding the convex portions, the contact energy can be reduced by about 60% from that in the first embodiment. If the contact energy is reduced, the contact noise is also reduced. According to an experiment performed under the above conditions, the contact noise in the first embodiment was 58 dB, and the contact noise in the fourth embodiment was 53 dB. That is, the contact noise was reduced by 5 dB.

As described above, by integrally forming on each shutter member 23 the convex portions 23*j*, 23*k*, 23*l*, and 23*m* with one of which the surface of the sheet comes into contact, the contact noise generated when the surface of the sheet conveyed by the pairs of conveying rollers 91 comes into contact with the shutter members 23 can be reduced. Thus, a sheet conveying device generating less noise and realizing improved throughput can be provided to users.

Figure 18:
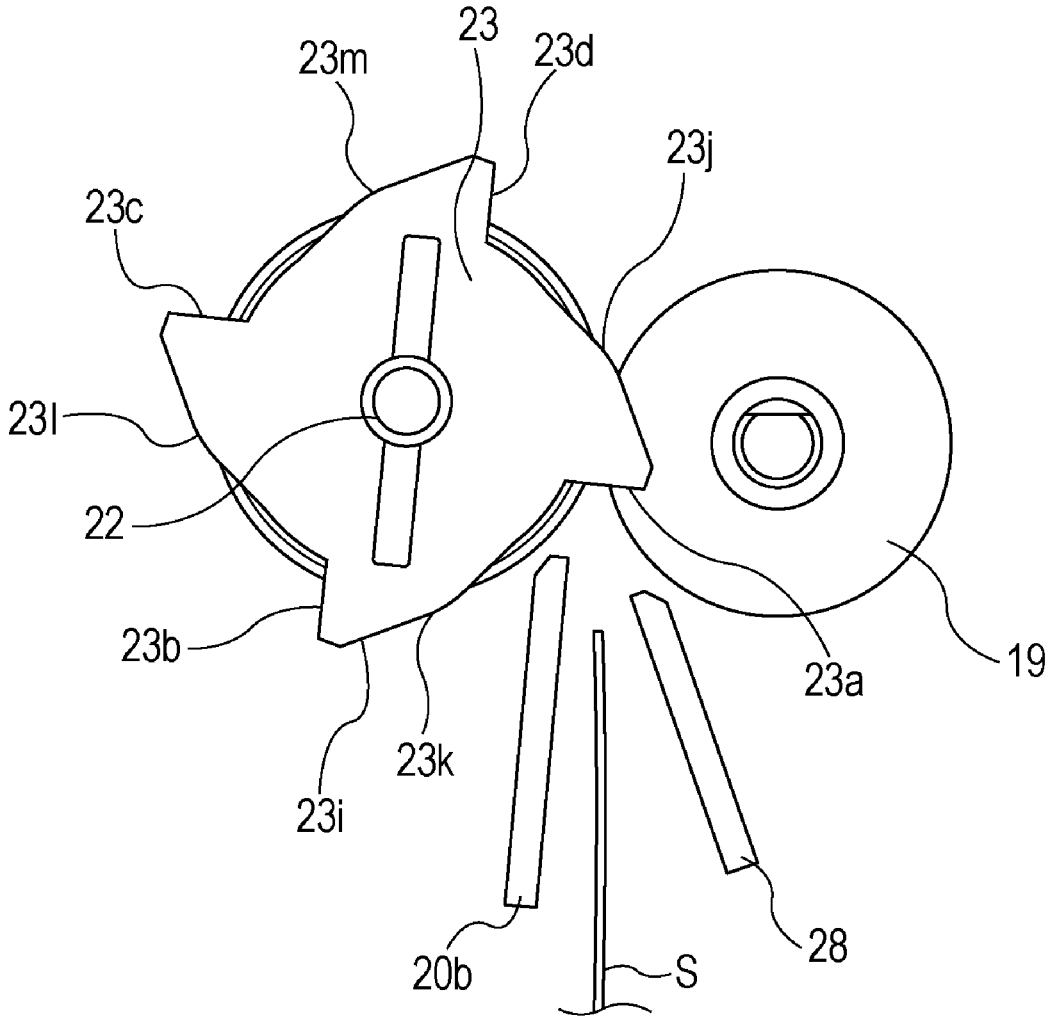
FIG. 18 is a cross-sectional view showing a variation of the shutter member included in the sheet conveying device according to the fourth embodiment.

In the above embodiment, the convex portions 23*j*, 23*k*, 23*l*, and 23*m* are integrally formed on each of the shutter members 23. Alternatively, the convex portions 23*j*, 23*k*, 23*l*, and 23*m* may be provided as separate components and are connected to the shutter members 23 with elastic members such as springs or the like. Furthermore, the convex portions may be provided by forming gentle slopes extending from the tips of each shutter member 23 as shown in FIG. 18. Even in such a configuration, the same advantageous effect is produced.

The configuration described in the fourth embodiment in which the convex portions are provided on the shutter members 23 can also be applied to the second or third embodiment.

Fifth Embodiment

Figure 19:
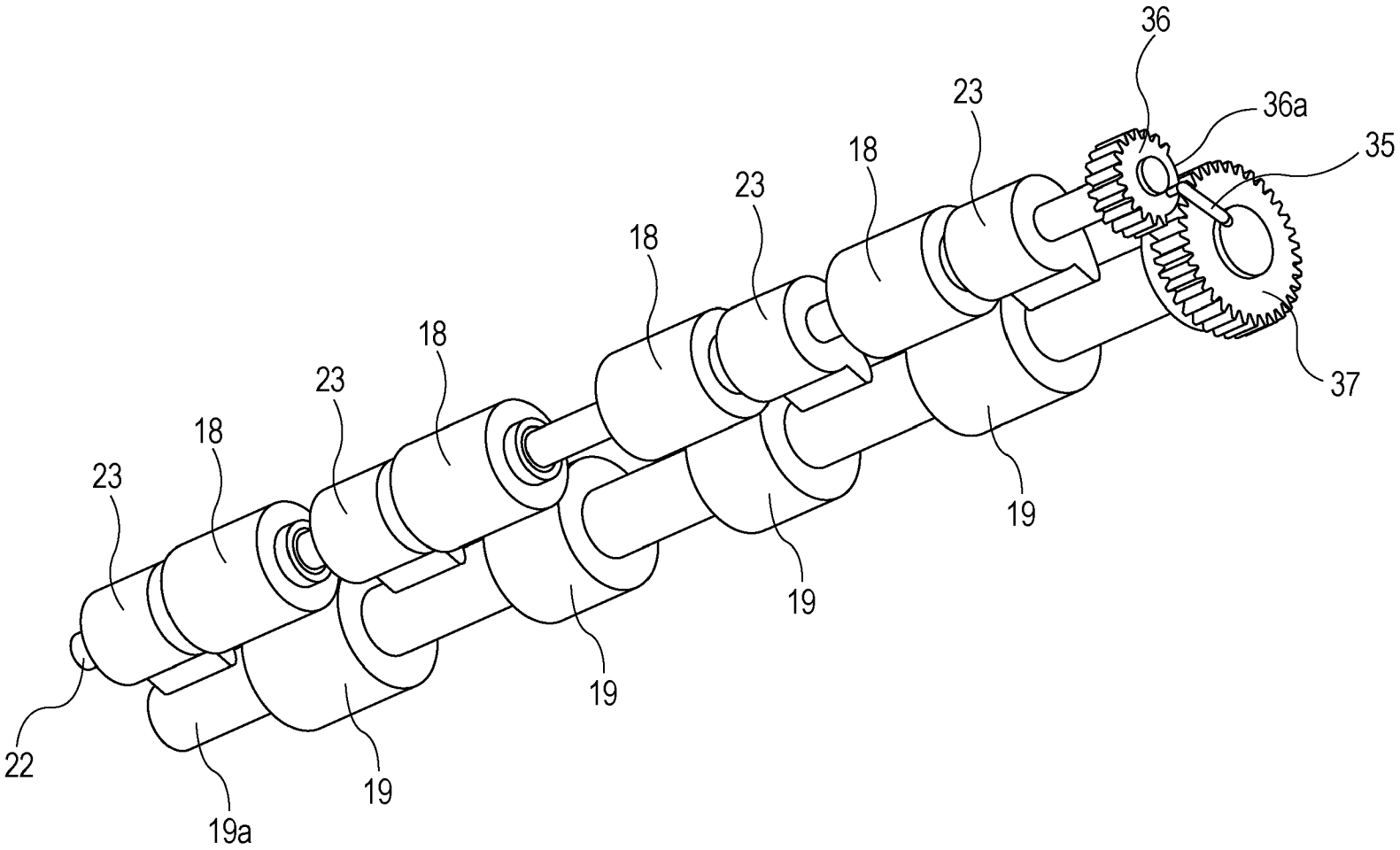
FIG. 19 is a perspective view showing the configuration of a sheet conveying device according to a fifth embodiment.

A fifth embodiment of the sheet conveying device and an image forming apparatus including the same according to the present invention will now be described with reference to FIGS. 19 to 20C. FIG. 19 is a perspective view showing a sheet conveying device according to the fifth embodiment. FIGS. 20A to 20C are plan views showing the sheet conveying device according to the fifth embodiment, wherein FIGS. 20A to 20C show the behavior occurring in this embodiment. Herein, configurations identical with those in the above embodiments are denoted by the corresponding reference numerals, whereby descriptions thereof are omitted.

In the first to fourth embodiment, the shutter members are rotated in the same direction as the sheet conveyance direction by causing the cam fixed on the shutter shaft to be pressed with a compression spring. In the fifth embodiment, the driving force from the motor, which is a drive unit, is transmitted through a partially toothless gear fixed on the shutter shaft 22. With the driving by the motor, the shutter members are rotated in the same direction as the sheet conveyance direction so as to be in the standby position.

The configuration according to the fifth embodiment will first be described. The shutter members 23 are fixed on the shutter shaft 22. In the fifth embodiment, the conveying rollers 18 are supported by the feed frame, and the shutter shaft 22 extends through the conveying rollers 18 and is rotatably supported by the feed frame, as in the first embodiment.

A partially toothless gear 36 is fixed to one end of the shutter shaft 22 with a spring pin or the like. The partially toothless gear 36, which rotates together with the shutter shaft 22 and the shutter members 23, has on the outer periphery thereof a toothless portion 36*a* where no teeth are provided. The partially toothless gear 36 can mesh with a driving gear 37 functioning as a transmission gear and provided on the driving shaft 19*a* for the driving rollers 19, which are rotatable driving members. The partially toothless gear 36 and the driving gear 37 in combination form a driving-force-transmitting mechanism that transmits a driving force for rotating the shutter members 23. That is, the partially toothless gear 36 and the driving gear 37 transmit the driving force from the motor, which is a drive unit that rotates the driving rollers 19, so as to rotate the shutter members 23. A tension spring 35, functioning as urging means, is stretched to the partially toothless gear 36. An urging force produced by the tension spring 35 in accordance with the position of the partially toothless gear 36 in the rotating direction acts on the shutter shaft 22 and the shutter members 23 through the partially toothless gear 36. This embodiment concerns a configuration in which the tension spring 35 is stretched to the partially toothless gear 36. Alternatively, the tension spring may be stretched to another component fixed on the shutter shaft 22 or to a shutter member 23.

The behavior occurring in the fifth embodiment will now be described.

Figure 20A:
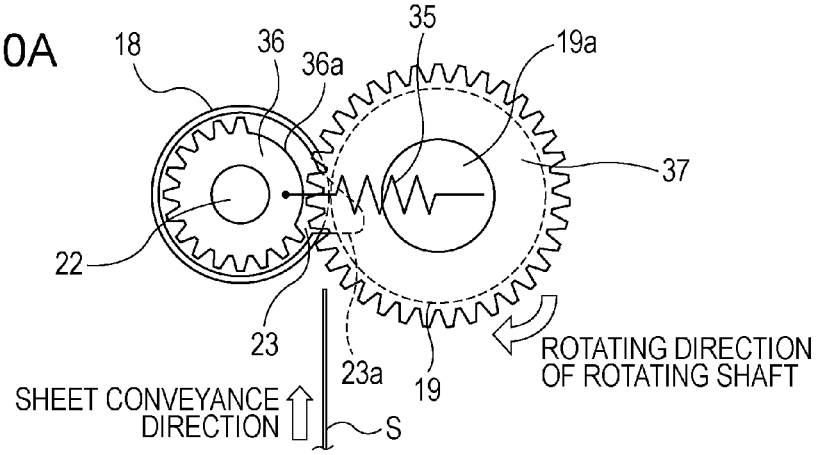
FIGS. 20A, 20B, and 20C are cross-sectional views showing the behavior of the sheet conveying device according to the fifth embodiment.

FIG. 20A shows a state immediately before the leading end of a sheet S comes into contact with the bumper surfaces 23*a* of the shutter members 23. The shutter members 23 subjected to the urging force of the tension spring 35 stand by in the standby position. That is, the tension spring 35 functions as positioning means for positioning the shutter members 23 to be in the standby position. In this state, as shown in FIG. 20A, since the toothless portion 36*a* of the partially toothless gear 36 faces the driving gear 37, the driving force transmitted to the driving gear 37 is not transmitted to the partially toothless gear 36.

When the leading end of the sheet S comes into contact with the bumper surfaces 23*a*, a loop is formed in the sheet S, and the shutter shaft 22 and the shutter members 23 are rotated by the sheet S having a specific stiffness. That is, the sheet causes the shutter shaft 22 and the shutter members 23 to rotate in such a direction as to retract from the sheet conveyance path against the urging force of the tension spring 35. In this process, the leading end of the sheet is aligned with the bumper surfaces of the shutter members 23, as in the embodiments described above.

While the leading end of the sheet is pushing the shutter members 23, the leading end of the sheet is nipped between the driving rollers 19 and the conveying rollers 18. Along with the rotation of the shutter members 23, the partially toothless gear 36 fixed on the shutter shaft 22 rotates together with the shutter shaft 22. When the leading end of the sheet S has reached the downstream side with respect to the nips between the driving rollers 19 and the conveying rollers 18, referring now to FIG. 20B, the partially toothless gear 36 and the driving gear 37 mesh with each other. When the partially toothless gear 36 and the driving gear 37 mesh with each other, the driving force transmitted to the driving gear 37 is transmitted to the partially toothless gear 36, whereby the shutter shaft 22 receives a rotational force acting to rotate the shutter shaft 22 and the shutter members 23 together with the partially toothless gear 36 in the direction of an arrow z5, i.e., in the sheet conveyance direction.

Figure 20B:
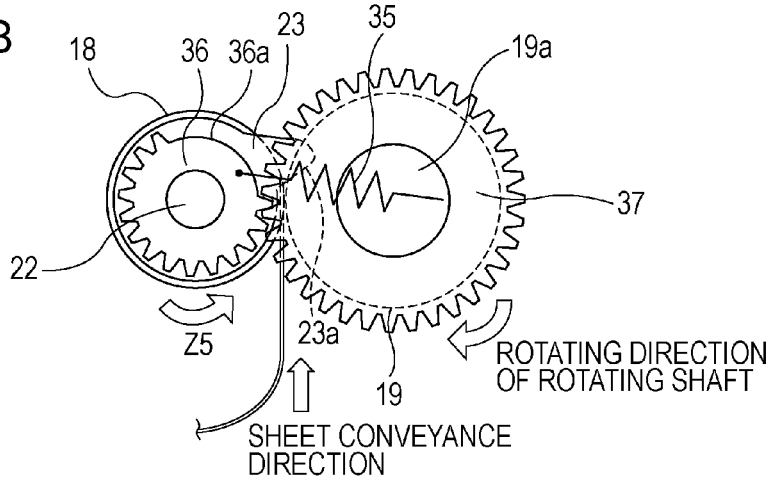
Figure 20C:
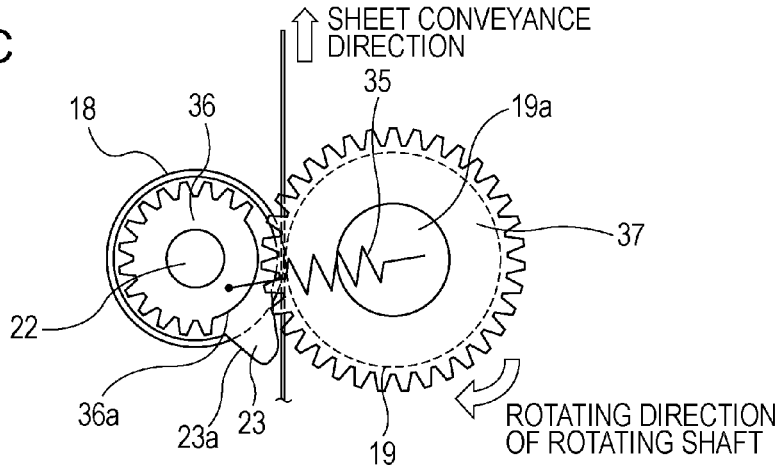

When the partially toothless gear 36 is rotated by the driving gear 37 in the above state to be in a position in which the toothless portion 36*a* thereof faces the driving gear 37 as shown in FIG. 20C, the transmission of the driving force from the driving gear 37 to the partially toothless gear 36 is stopped.

The shutter members 23 that are in the sheet-passage-allowing orientation in which the sheet is allowed to pass, as shown in FIG. 20C, are urged clockwise with the urging force of the tension spring 35. However, the rotation of the shutter members 23 is prevented because the shutter members 23 are in contact with the surface of the sheet. When the sheet S is further conveyed and the trailing end thereof has left the shutter members 23, the shutter members 23 subjected to the urging force of the tension spring 35 rotate in the sheet conveyance direction and return to be in the standby position, shown in FIG. 20A, so as to be prepared for the entry of the leading end of the subsequent sheet.

Thus, for every conveyance of a sheet, the shutter shaft 22 together with the shutter members 23 and the partially toothless gear 36 fixed on the shutter shaft 22 rotate in the same direction as the sheet conveyance direction in such a manner as to sequentially produce the states shown in FIGS. 20A, 20B, and 20C in that order while the transmission of the driving force and the stoppage of the transmission are performed repeatedly.

Sixth Embodiment

Figure 21:
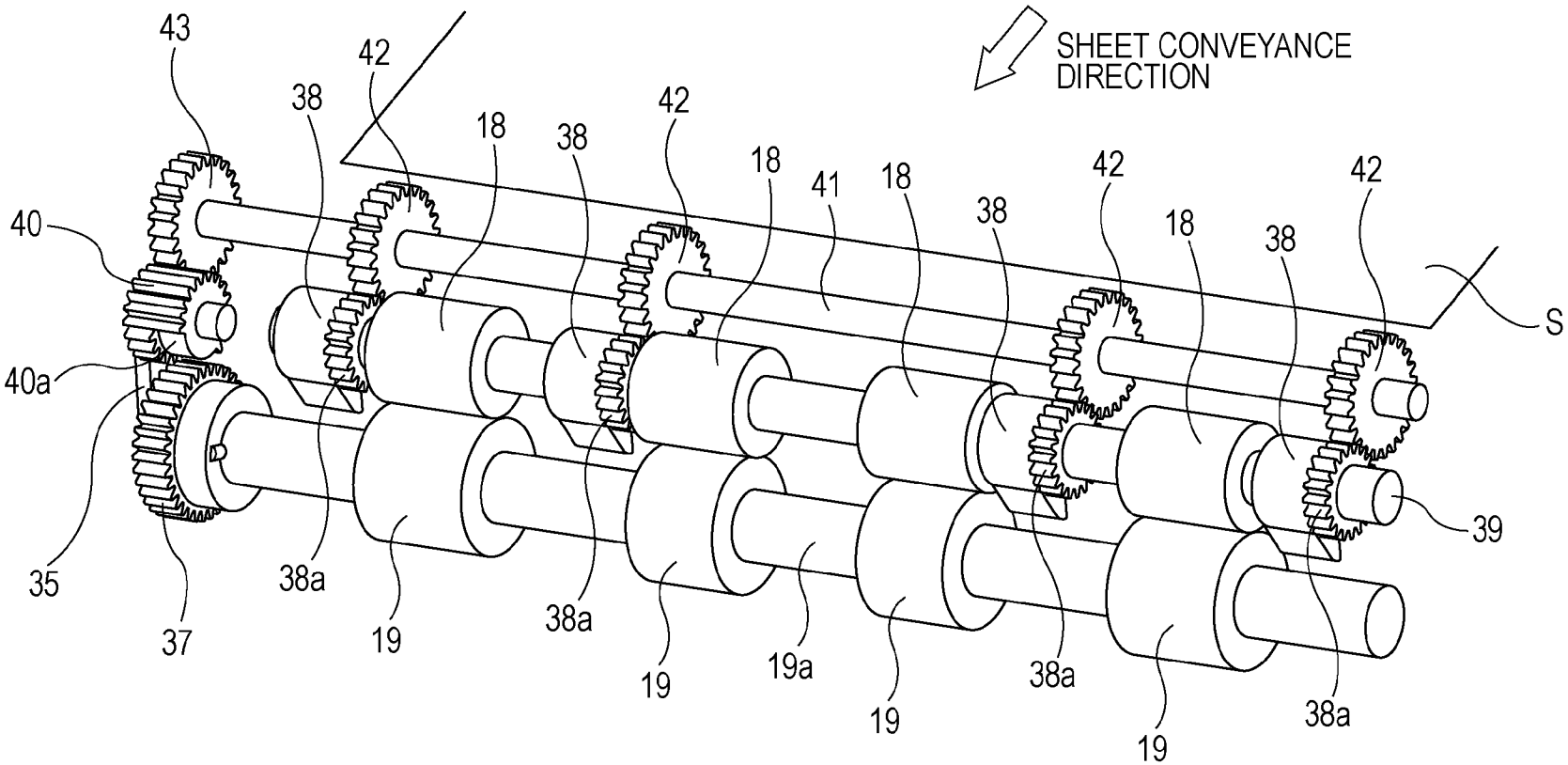
FIG. 21 is a perspective view showing the configuration of a sheet conveying device according to a sixth embodiment.
Figure 22:
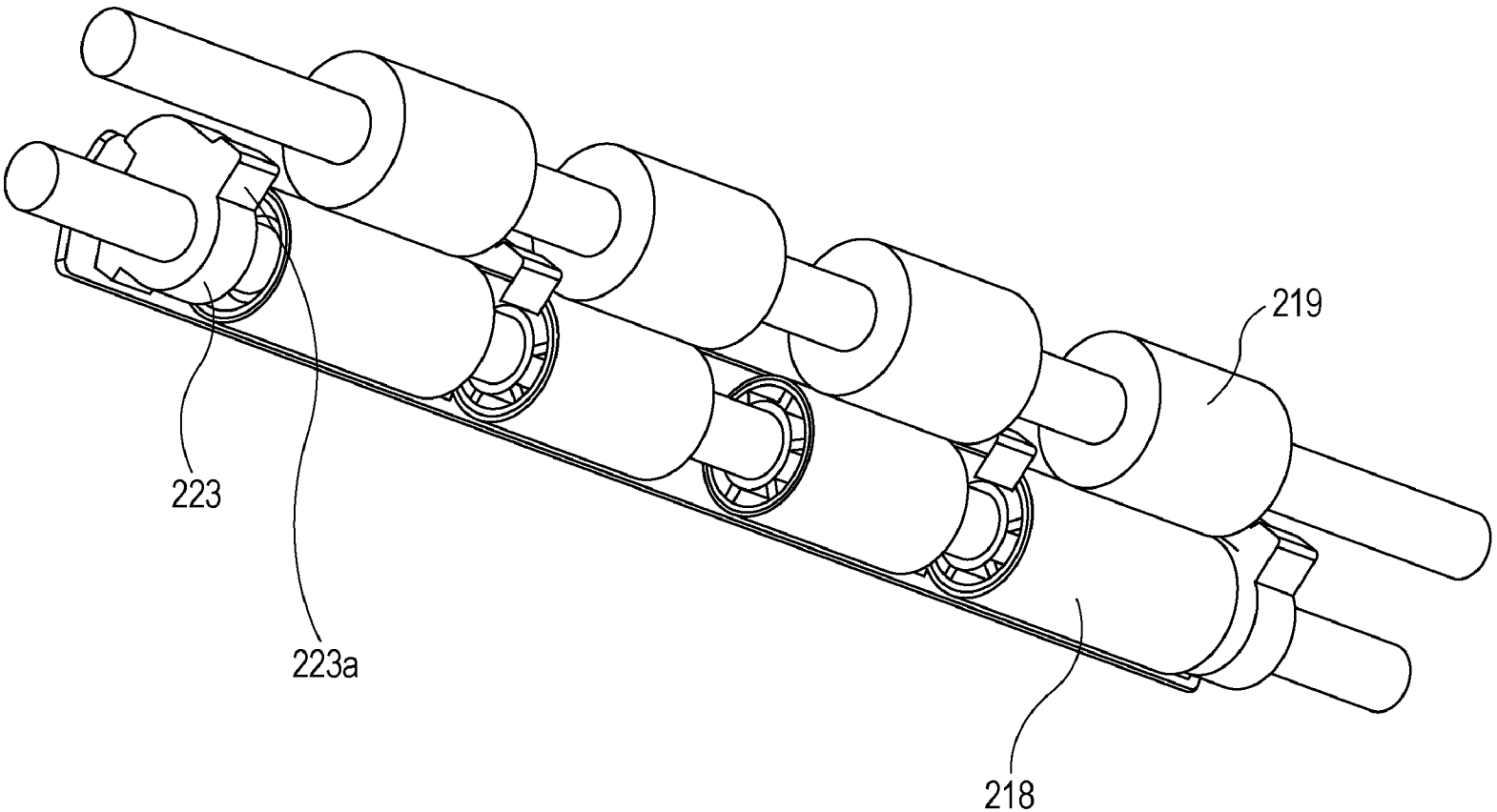
FIG. 22 is a perspective view showing the prior art.
Figure 23A:
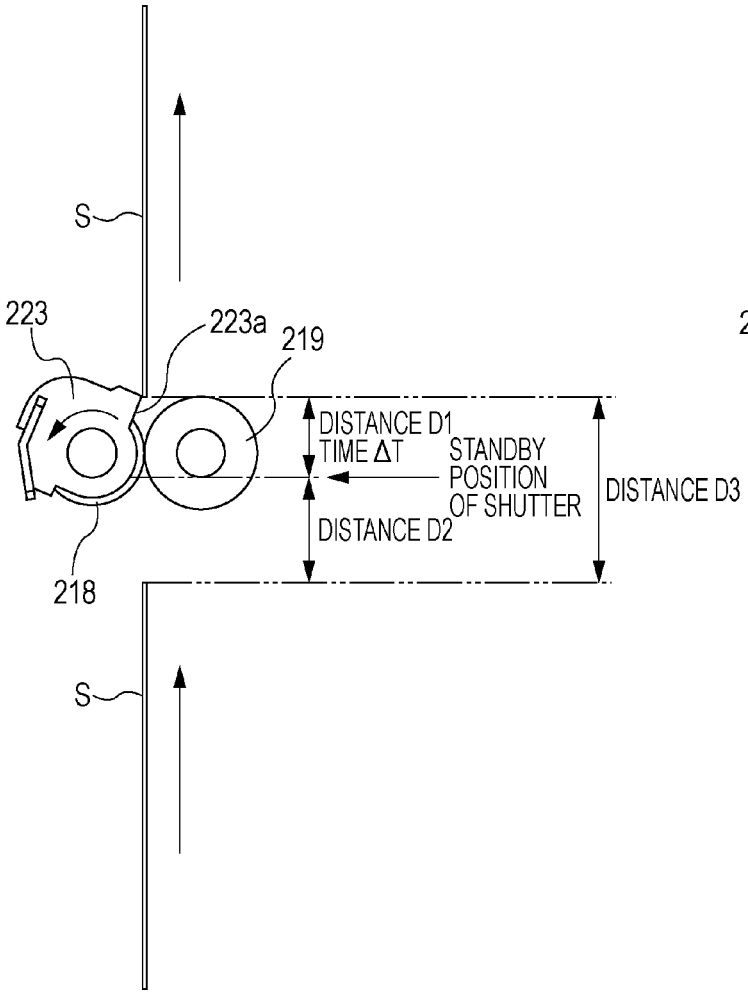
FIGS. 23A and 23B are cross-sectional views for describing a problem in the prior art.
Figure 23B:
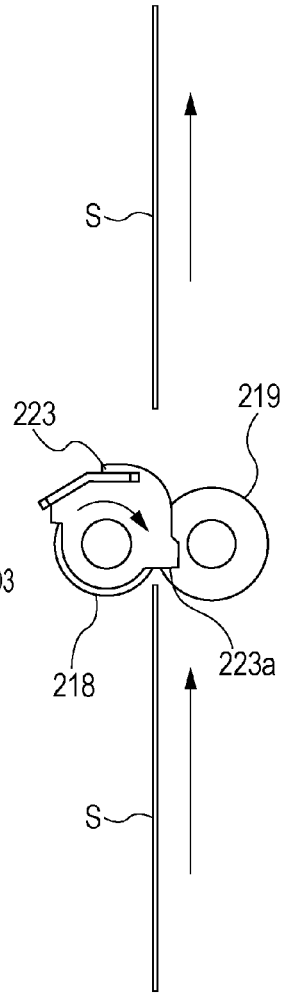

A sixth embodiment of the sheet conveying device and an image forming apparatus including the same according to the present invention will now be described with reference to FIG. 21. FIG. 21 is a perspective view showing a sheet conveying device according to this embodiment. Herein, configurations identical with those in the fifth embodiment are denoted by the corresponding reference numerals, whereby descriptions thereof are omitted.

In the fifth embodiment, the conveying rollers 18 are supported by the feed frame and the shutter members are fixed on the shutter shaft 22 extending through the conveying rollers 18, whereby the shutter shaft and the shutter members rotate together about the center of rotation of the conveying rollers. In contrast, in the sixth embodiment, the conveying rollers 18 are fixed on a conveying roller shaft 39 that is supported by the feed frame, and the shutter members are rotatably supported by the conveying roller shaft 39.

The configuration according to the sixth embodiment will now be described in detail with reference to the perspective view shown in FIG. 21.

In the sixth embodiment, the conveying roller shaft 39 supports shutter members 38. The shutter members 38 are supported in such a manner as to be rotatable with respect to the conveying roller shaft 39. The conveying roller shaft 39 is provided with the conveying rollers 18 arranged thereon in the axial direction. The shutter members 38 are provided with gear portions 38*a*, respectively, integrally formed thereon.

The shutter members 38 are set to be in phase with each other by a shutter driving shaft 41 provided separately from the driving shaft 19*a* and the conveying roller shaft 39. Specifically, a plurality of shutter driving gears 42 are fixed on the shutter driving shaft 41 and are arranged in the axial direction at the same intervals as those of the shutter members 38. The shutter driving gears 42 mesh with the gear portions 38*a* of the shutter members, respectively. Furthermore, an idler gear 43 is fixed at one end of the shutter driving shaft 41. The idler gear 43 can mesh with a partially toothless gear 40. The idler gear 43 and the shutter driving gears 42 have the same number of teeth. The partially toothless gear 40 can mesh with the driving gear 37 functioning as a transmission gear. The driving gear 37, the partially toothless gear 40, the idler gear 43, the shutter driving shaft 41, the shutter driving gears 42, and the gear portions 38*a* in combination form a driving-force-transmitting mechanism for transmitting a driving force for rotating the shutter members 38.

In the sixth embodiment, the transmission of the driving force to the shutter members 38 and the stoppage of the transmission are realized by the partially toothless gear 40 and the tension spring 35 stretched thereto, as in the fifth embodiment. In the sixth embodiment, a toothless portion 40*a* of the partially toothless gear 40 only extends halfway in the tooth width direction (axial direction). The meshing between the driving gear 37 and the partially toothless gear 40 is released at the toothless portion 40*a*. Whereas, the idler gear 43 provided on the shutter driving shaft 41 constantly meshes with the partially toothless gear 40, thereby rotating constantly together with the partially toothless gear 40.

The behavior occurring in the sixth embodiment is similar to that in the fifth embodiment, in which the transmission of the driving force and the stoppage of the transmission are performed repeatedly, and the shutter members 38 repeatedly rotate in the same direction as the sheet conveyance direction for every conveyance of a sheet.

That is, when the shutter members 38 are in the standby position, the toothless portion 40*a* of the partially toothless gear 40 faces the driving gear 37. When the leading end of a sheet S that is being conveyed comes into contact with the bumper surfaces of the shutter members 38, the sheet S is blocked with the urging force of the tension spring 35, whereby a loop is formed in the sheet. The shutter members 38 rotate with respect to the conveying roller shaft 39 with a specific stiffness of the sheet S. When the shutter members 38 rotate by being pushed by the sheet that is being conveyed, the shutter members 38 having the gear portions 38*a* rotate, and the shutter driving gears 42 meshing with the gear portions 38*a* rotate. When the shutter driving gears 42 rotate, the partially toothless gear 40 rotates through the intermediary of the idler gear 43.

When the leading end of the sheet S nipped by the driving rollers 19 and the conveying rollers 18 has reached the downstream side with respect to the nips between the driving rollers 19 and the conveying rollers 18, the partially toothless gear 40 and the driving gear 37 mesh with each other. When the partially toothless gear 40 and the driving gear 37 mesh with each other, the driving force of the motor for rotating the driving shaft 19*a* is transmitted from the driving gear 37 to the partially toothless gear 40, causing the shutter members 38 to rotate in the sheet conveyance direction through the intermediary of the idler gear 43 and the shutter driving gears 42.

When the toothless portion 40*a* of the partially toothless gear 40 faces the driving gear 37 while the shutter members 38 are rotating in such a manner, the transmission of the driving force from the driving gear 37 to the shutter members 38 is stopped. Then, the shutter members 38 subjected to the urging force of the tension spring 35 receive such a rotational force that the shutter members 38 are rotated toward the standby position, i.e., in the counterclockwise direction. As in the fifth embodiment, even though the rotational force acting to rotate the shutter members 38 counterclockwise is applied to the shutter members 38, the rotation of the shutter members 38 is prevented because the shutter members 38 are in contact with the surface of the sheet before the trailing end of the sheet S passes the shutter member 38. When the sheet is further conveyed and the trailing end of the sheet has left the shutter members 38, the shutter members 38 subjected to the urging force of the tension spring 35 rotate counterclockwise to be in the standby position, thereby being prepared for the subsequent sheet.

In the sixth embodiment, the conveying rollers 18 are supported by the conveying roller shaft 39, and the conveying rollers 18 are pressed against the driving rollers 19 such that the conveying roller shaft 39 is urged against the driving rollers 19 with an unshown spring. Therefore, even in a case where a shutter shaft on which the shutter members are to be fixed cannot be provided in conjunction with the conveying rollers 18, the bumper surfaces of the shutter members 38 can be oriented in phase with each other, and the driving force for rotating the shutter members 38 in the same direction as the sheet conveyance direction can be transmitted.

This embodiment concerns a configuration in which the shutter members 38 are supported by the conveying roller shaft 39. Alternatively, the shutter members 38 may be supported by the driving shaft 19*a*.

In each of the fifth and sixth embodiments, the detecting member operating in conjunction with the shutter members 23 or 38 and turning the detection sensor 33 on and off may also be provided so that the sheet is detected, as described in the third embodiment.

According to the present invention, after the leading end of a sheet that is being conveyed comes into contact with the blocking surface of the blocking member that is in the standby position and when the trailing end of the sheet has passed the blocking member from the sheet-passage-allowing orientation in which the sheet is allowed to pass, the blocking member rotates in the sheet conveyance direction and is positioned to be in the standby position. Therefore, the throughput in sheet conveyance can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/068078, filed Oct. 20, 2009, which is hereby incorporated by reference herein in its entirety.

REFERENCE SIGNS LIST

18 conveying roller
19 driving roller

19*a* driving shaft
20 feed frame
22 shutter shaft
23 shutter member
24 shutter cam
25 pressing member
26 cam follower
27 shutter spring

The invention claimed is:

1. A sheet conveying device comprising:

a conveying section that conveys a sheet;

a blocking member that rotates in a predetermined rotating direction and has a blocking surface with which a leading end of the sheet that is being conveyed by the conveying section comes into contact for obliquity correction; and a positioning unit that positions the blocking member to be in a standby position and includes a spring which applies a force to the blocking member, wherein the blocking member is rotated in the predetermined rotating direction from the standby position by being pushed by the sheet that is being conveyed by the conveying section against the force applied by the spring of the positioning unit, and the blocking member is rotatable to be in a sheet-passage-allowing orientation in which the sheet is allowed to pass, and, when a trailing end of the sheet that is being conveyed passes the blocking member, the blocking member rotates from the sheet-passage-allowing orientation in the predetermined rotating direction to the standby position by the force applied by the spring of the positioning unit.

2. The sheet conveying device according to claim 1, further comprising:

a pair of rotatable members provided on a downstream side in the sheet conveyance direction with respect to the conveying section and conveying the sheet while nipping the sheet, wherein the pair of rotatable members are arranged such that, while the leading end of the sheet that is in contact with the blocking surface is rotating the blocking member in the predetermined rotating direction, the leading end of the sheet is nipped by the pair of rotatable members, and wherein the blocking member rotates in the predetermined rotating direction while the sheet is conveyed by the pair of rotatable members, thereby being positioned in the sheet-passage-allowing orientation in which the blocking member is in contact with a surface of the sheet that is being conveyed.

3. The sheet conveying device according to claim 2, wherein the positioning unit comprises a cam provided on a rotating shaft of the blocking member and urged by the spring, wherein the cam is shaped such that the force applied by the spring acting through the intermediary of the cam acts on the blocking member as a reactive force against the leading end of the sheet while the leading end of the sheet that is being conveyed is rotating the blocking member after having come into contact with the blocking surface, and that, after the leading end of the sheet has been nipped by the pair of rotatable members and while the blocking member is being pushed to rotate by the leading end of the sheet that is being conveyed by the pair of rotatable members, a direction in which the force applied by the spring is made to act on the blocking member is changed to such a direction that the blocking member is rotated in the predetermined rotating direction.

4. The sheet conveying device according to claim 2, wherein the blocking member rotates about a center of rotation the same as a center of rotation of one of the pair of rotatable members, and wherein the rotating shaft of the blocking member extends through the one rotatable member in such a manner as not to be in contact with the one rotatable member.

5. The sheet conveying device according to claim 1, wherein the blocking member has a plurality of blocking surfaces arranged in a peripheral direction thereof; and wherein the blocking member that is in the standby position in which the leading end of the sheet is to come into contact with one of the blocking surfaces rotates in the predetermined rotating direction, thereby being positioned in the standby position in which a leading end of a subsequent sheet is blocked by another one of the blocking surfaces.

6. The sheet conveying device according to claim 1, wherein the blocking member is in the sheet-passage-allowing orientation by being in contact at a contact point thereof with the surface of the sheet that is being conveyed, and wherein the contact point is on an inner side in a radial direction of the blocking member with respect to an outermost point of the blocking member.

7. The sheet conveying device according to claim 2, further comprising:

a driving-force-transmitting mechanism that transmits a driving force from a drive unit to the blocking member, wherein the driving-force-transmitting mechanism includes a partially toothless gear and a transmission gear meshing with the partially toothless gear and rotating when the driving force of the drive unit is transmitted thereto, wherein a toothless portion of the partially toothless gear faces the transmission gear when the blocking member is in the standby position, and wherein, when the leading end of the sheet that is being conveyed has come into contact with the blocking surface of the blocking member and the blocking member is then pushed to rotate by the sheet that is being conveyed, the partially toothless gear rotates together with the blocking member and meshes with the transmission gear, whereby the blocking member is rotated in the rotating direction and is positioned in the sheet-passage-allowing orientation.

8. The sheet conveying device according to claim 7, further comprising:

a rotating shaft that rotates together with the blocking member, wherein the partially toothless gear is provided on the rotating shaft, and wherein the transmission gear is provided on a shaft for a rotatable driving member included in the pair of rotatable members.

9. An image forming apparatus comprising:

the sheet conveying device according to claim 1; and an image forming section forming an image on a sheet having any obliquity thereof corrected by the sheet conveying device.

10. The image forming apparatus according to claim 9, further comprising a detection sensor to be turned on and off, for detecting the sheet that is being conveyed, in accordance with a movement of the blocking member that rotates by being pushed by the sheet that is being conveyed.

* * * * *